US006749279B2

(12) United States Patent
Kobayashi et al.

(10) Patent No.: US 6,749,279 B2
(45) Date of Patent: Jun. 15, 2004

(54) INKJET RECORDING DEVICE CAPABLE OF CONTROLLING EJECTION TIMING OF EACH NOZZLE INDIVIDUALLY

(75) Inventors: Shinya Kobayashi, Hitachinaka (JP); Eiichi Toyama, Hitachinaka (JP); Hitoshi Kida, Hitachinaka (JP); Kunio Satou, Hitachinaka (JP); Takashi Sekino, Hitachinaka (JP); Susumu Saito, Hitachinaka (JP)

(73) Assignee: Hitachi Printing Solutions, Ltd., Kanagawa (JP)

( * ) Notice: Subject to any disclaimer, the term of this patent is extended or adjusted under 35 U.S.C. 154(b) by 38 days.

(21) Appl. No.: 10/303,915

(22) Filed: Nov. 26, 2002

(65) Prior Publication Data

US 2003/0142160 A1 Jul. 31, 2003

(30) Foreign Application Priority Data

Nov. 30, 2001 (JP) ..... P2001-367743
Jan. 25, 2002 (JP) ..... P2002-016918

(51) Int. Cl.[7] ..... B41J 29/38; B41J 2/015

(52) U.S. Cl. ..... 347/14; 347/20

(58) Field of Search ..... 347/14, 20, 19, 347/40

(56) References Cited

U.S. PATENT DOCUMENTS 5,924,804 A * 7/1999 Hino et al. ..... 400/118.2

FOREIGN PATENT DOCUMENTS

DE 3208104 A1 * 9/1983 ..... B41J/3/10
JP 11-78013 3/1999

* cited by examiner

*Primary Examiner*—Thinh Nguyen
(74) *Attorney, Agent, or Firm*—Whitham, Curtis & Christofferson, PC

(57) ABSTRACT

When a pixel-dividing number is increased to a predetermined number or more, then nozzles in each nozzle group become in one-to-one correspondence with the sub-pixel number, so that only one of the nozzles performs ink ejection at one time. Accordingly an analog driving signal drives only a single nozzle in the corresponding group at one time. Therefore, by trimming the analog driving signal in accordance with a subject nozzle each time, the all-amount trimming is possible without providing a large number of analog-driving-signal generating devices for all of the nozzles.

17 Claims, 21 Drawing Sheets

INKJET RECORDING DEVICE CAPABLE OF CONTROLLING EJECTION TIMING OF EACH NOZZLE INDIVIDUALLY

BACKGROUND OF THE INVENTION

1. Field of the Invention

The present invention relates to an ejection device that ejects droplets of liquid, and more specifically to an ejection device capable of precisely ejecting droplets at high speed in desired resolutions.

2. Related Art

Japanese Patent-Application Publication No. HEI-11-78013 discloses an inkjet recording device, which is one example of droplet ejection devices. Such an inkjet recording device includes an elongated inkjet recording head formed with a plurality of nozzles aligned equidistance from each other. The nozzle line is angled with respect to a sheet feed direction in which a recording medium is transported. When an energy generating element of each nozzle is applied with a driving voltage based on a recording signal, then a pressure is applied to ink inside an ink chamber, thereby an ink droplet is ejected through an orifice. Thus ejected ink droplet reaches the recording medium and forms a recording dot thereon. Recording operations are performed in this manner. This type of inkjet recording device has a simple configuration and is capable of high speed printing.

FIG. 1(*a*) shows a piezoelectric-element driver 1420, which is one example of conventional piezoelectric-element drivers, connected to 128-number of piezoelectric elements 304. A common power source 202 is connected to a common terminal 304*b* of each piezoelectric element 304 for supplying a 40V direct current to the piezoelectric elements 304 which could be driven by at least 10V electric current. The piezoelectric-element driver 1420 includes 128-number of switches 1203 connected to the corresponding 128-number of piezoelectric elements 304, a 128-bit latch 204, a 128-bit shift register 205, and a rectangular-waveform generating circuit 1206. A binary ejection signal 207 is input to the shift register 205 and shifts one bit at a time in synchronization with the shift-clock S-CLK. The ejection signal 207 having a value "1" indicates "ejection", and the ejection signal 207 having a value "0" indicates "non-ejection". The latch 204 latches 128-bit data from the shift register 205 in synchronization with a pixel-synchronization signal 109 (latch clock L-CLK). The rectangular-waveform generating circuit 1206 generates a common output-enable (OE) signal 206 having a predetermined width in synchronization with the latch clock L-CLK. A logical product of an output from the latch 204 and the common OE signal 206 is input to a switching terminal of each switch 1203. The switch 1203 connects the individual terminal 304*a* of the piezoelectric element 304 to the ground when a value "1" is applied to the switch terminal, so that a driving waveform Vpzt shown in FIG. 1(*b*) is applied to the piezoelectric element 304. On the other hand, the switch 1203 connects the individual terminal 304*a* to the common power source 202 when a value "0" is applied, so that no driving waveform Vpzt is applied to the piezoelectric element 304.

An example of operations of the piezoelectric-element driver 1420 will be described with reference to the timing chart of FIG. 1(*b*). In this example, the common OE signal 206 is a well-known rectangular waveform having a driving voltage of 40V and a time-width of 5 $\mu$m to 25 $\mu$m. When the pixel-synchronization signal 109 is received, then the pixel-synchronization signal 109 is input as the latch clock L-CLK to the latch 204 so that the ejection signals 207 that have been stored in the shift register 205 in a previous cycle are stored in the latch 204 at once. Then, the common OE signal 206 that is generated in synchronization with the pixel-synchronization signal 109 is input to the AND circuit. As a result, nozzles whose ejection signals 207 have the value of "1" eject ink droplets, and nozzles whose ejection signals 207 have the value of "0" eject no ink droplets. Then, subsequent ejection signals 207 are input to the shift register 205 in synchronization with the shift-clock S-CLK, and the process waits until the next pixel-synchronization signal 109 is generated.

There have been also provided piezoelectric-element drivers having different configurations. However, these drivers are common in applying an analog voltage to the common terminals of the piezoelectric elements and in switching the connection at the individual terminals. This type of piezoelectric-element driver has a simple configuration and is particularly indispensable in multi-nozzle inkjet recording devices.

Here, in order to form high-quality half toning images like photographical images, multiple level halftoning that creates the appearance of intermediate tones of black, white, and a plurality of gray levels is necessary. There have been known two methods for realizing such multiple tone levels. The one is to control a number of recording dots in a single pixel area, and the other is to change a mass of each droplet by controlling a corresponding driving waveform Vpzt. The latter method is known to be preferable in highly-reliable high-speed inkjet recording devices.

It is conceivable to control an individual driving waveforms Vpzt by providing an individual driving circuit for each one of the nozzles. However, it is not practical to provide so many driving circuits in a multi-nozzle inkjet recording device that includes a great number of nozzles since it greatly increases manufacturing costs of the device. Moreover, in a conventional piezoelectric-element driver such as those shown in FIG. 1(*a*), it is necessary to change the analog voltage from the power source 202 each time for each nozzle in order to change the driving waveform Vpzt. However, it is difficult to change the analog voltage in such a manner.

A recording resolution is determined by a nozzle density. For example, if the nozzle density is 300 nozzles per inch (npi), then the recording resolution is usually 300 dots per inch (dpi). In order to form a 240 dpi image using a recording device having the nozzle density of 300 dpi, a well-known digital data process, such as enlargement process, high-resolution process, or the like is previously performed to obtain converted data, and then the recording is performed based on thus obtained data.

SUMMARY OF THE INVENTION

However, it is preferable to avoid such a digital data process since the process usually changes or degrades image quality, disabling to provide images desired by users.

In view of forgoing, therefore, it is an object of the present invention to overcome the above problems and also to provide a high-speed ejection device having an elongated head capable of ejecting droplets on precise locations in a designated resolution.

It is also an object of the present invention to provide a multi-nozzle inkjet recording device capable of stably forming high-quality multi-toning images by changing a mass of each ink droplet.

In order to achieve the above and other objects, according to the present invention, there is provided an ejection device including a head formed with a plurality of nozzles arranged in a row for selectively ejecting droplets from the nozzles so as to form dots onto a medium, a transporting means for transporting the medium relative to the head in a first direction, a resolution specifying means for specifying a resolution with respect to the first direction, a preciseness specifying means for specifying preciseness in dot locations on the medium, an angle specifying means for specifying an angle of the head with respect to a second direction perpendicular to the first direction based on the specified resolution, a sub-pixel determining means for determining a size of a sub-pixel with respect to the first direction based on the specified preciseness, a converting means for converting an ejection data to a sub-pixel data based both on the specified resolution and the size of the sub-pixel, and a control means for controlling the head based on the sub-pixel data to selectively ejecting the droplets from the nozzles.

There is also provided an ejection device including a head formed with a plurality of nozzles arranged in a row that is angled with respect to a first direction, a transporting means for transporting a medium with respect to the head in a second direction perpendicular to the first direction, a timing-signal generating means for generating a timing signal in accordance with a position of the medium, a driving-signal generating means for generating a driving signal in synchronization with the timing signal, a converting means for converting an ejection-tone data into a pulse-width signal in synchronization with the timing signal, a chance-signal providing means for providing a chance signal that provides a chance for ejection to a selected one of the nozzles at a time in synchronization with the timing signal, and a control means for controlling the head to selectively eject a droplet from the selected nozzle based on the driving signal, on the pulse-width signal, and on the chance signal.

BRIEF DESCRIPTION OF THE DRAWINGS

In the drawings:

FIG. 1(*b*) shows a timing chart of the conventional piezoelectric-element driver of FIG. 1(*a*);

FIG. 16(*b*) shows a timing chart of the pulse-width adjusting unit of FIG. 16(*a*);

FIG. 17(*b*) is a timing chart of the piezoelectric-element driver of FIG. 17(*a*);

FIG. 18(*b*) shows ejection data arranged for each nozzle module;

FIG. 18(*c*) shows ejection data rearranged in an ejection order;

PREFERRED EMBODIMENTS OF THE PRESENT INVENTION

Next, inkjet recording devices serving as ejection devices according to embodiments of the present invention will be described.

Figure 1A:
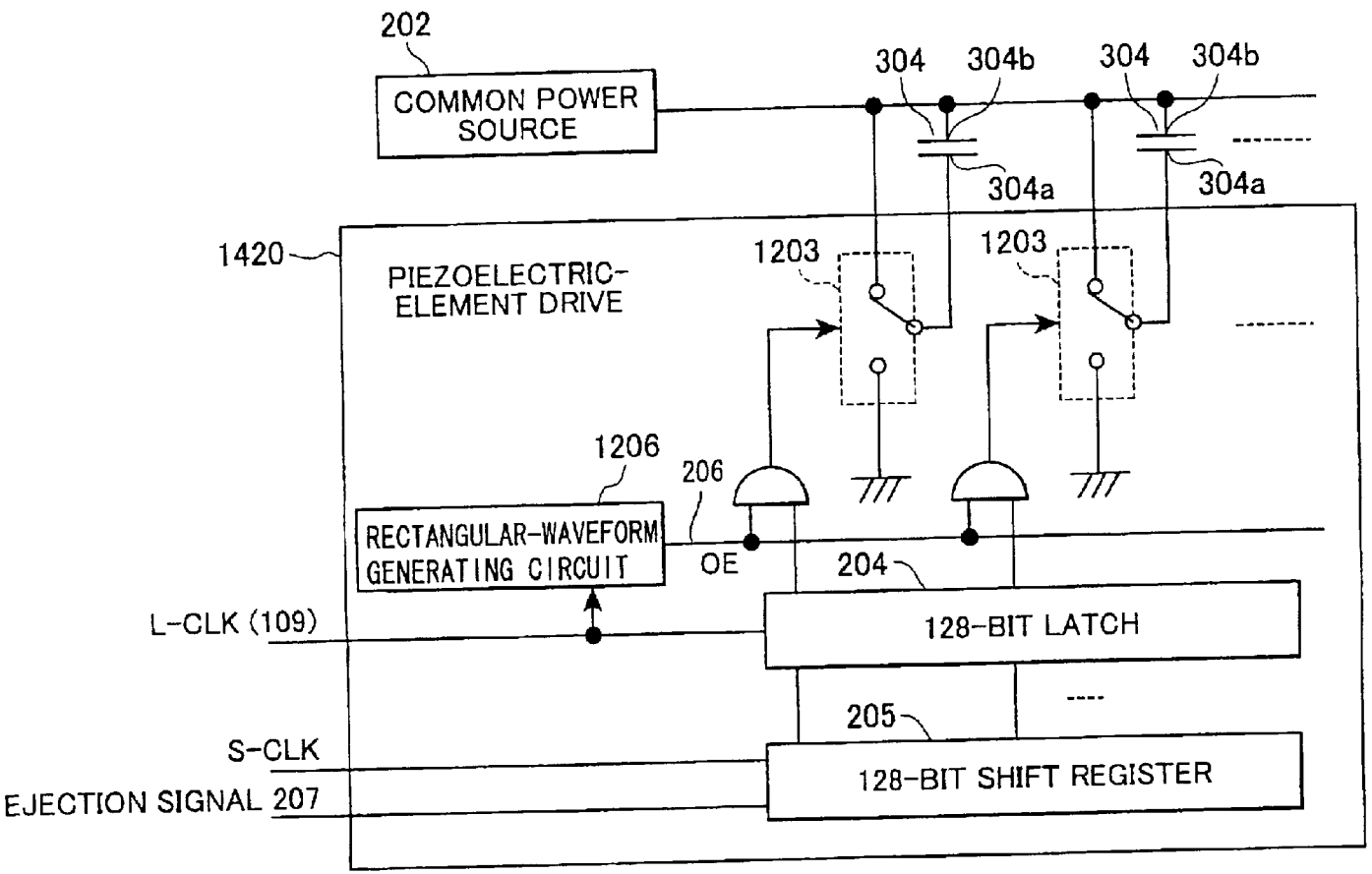
FIG.1(a) RELATED ART
FIG. 1(*a*) shows a configuration of a conventional piezoelectric-element driver connected to piezoelectric elements and a common power source.
Figure 1B:
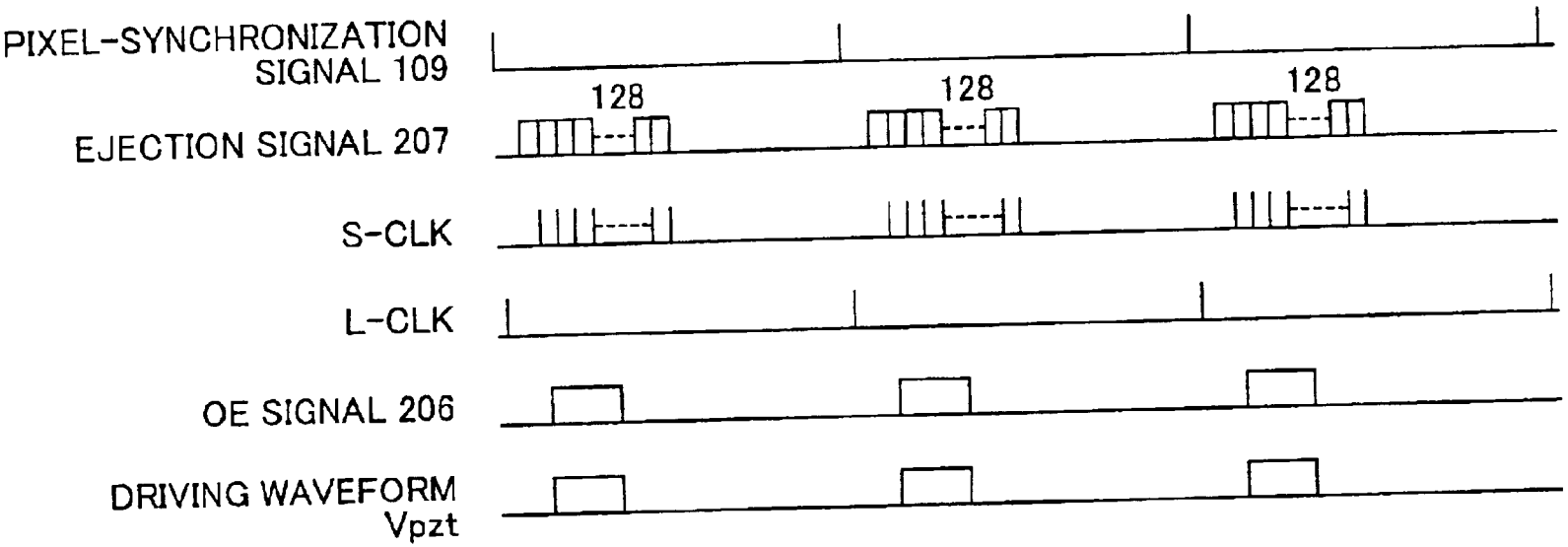
FIG.1(b) RELATED ART
Figure 2:
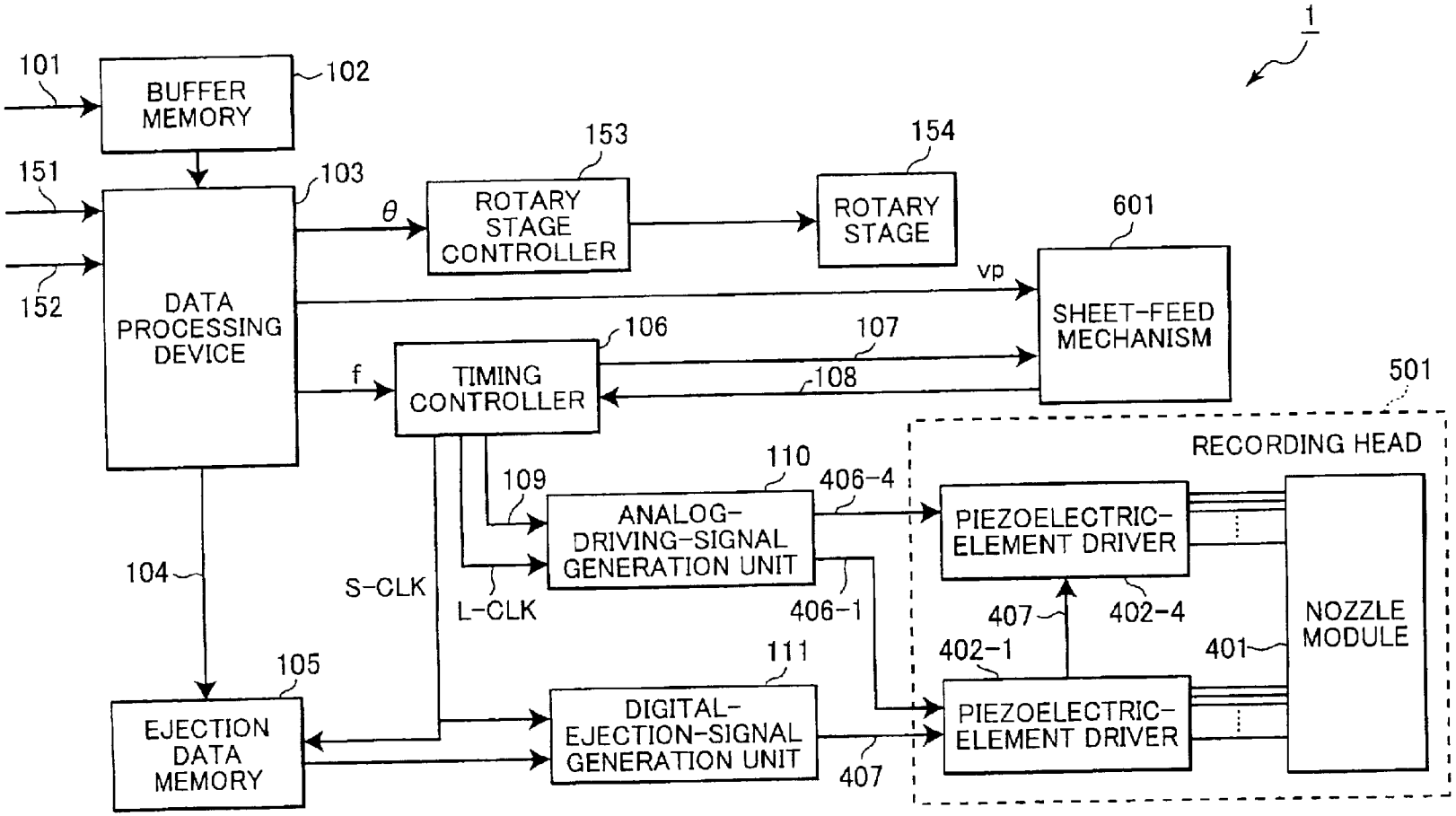
FIG. 2 shows an overall configuration of an inkjet recording device according to a first embodiment of the present invention.

FIG. 2 shows an inkjet recording device 1 according to a first embodiment. As shown in FIG. 2, the inkjet recording device 1 includes a sheet feed mechanism 601, a recording head 501, and a rotary stage 154. The recording head 501 is mounted on the sheet feed mechanism 601, and the rotary stage 154 is attached to the recording head 501.

Figure 3:
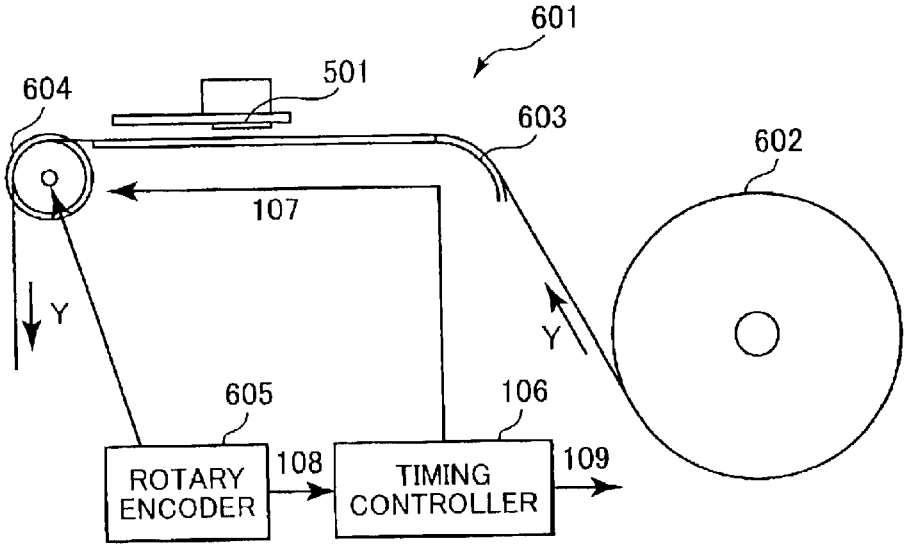
FIG. 3 is a plan view of a sheet feed mechanism of the inkjet recording device of FIG. 2.

As shown in FIG. 3, the sheet feed mechanism 601 includes a continuous recording sheet 602, a guide 603, a driving roller 604, a rotary encoder 605, and a transport mechanism (not shown). The transport mechanism transports the continuous recording sheet 602 along the guide 603 in a sheet feed direction Y so that the continuous recording sheet 602 reaches beneath the recording head 501 and discharged via the driving roller 604. The rotary encoder 605 is attached to the driving roller 604, and generates a sheet-position indication pulse 108 in accordance with a location of the continuous recording sheet 602 with respect to the sheet feed direction Y in a precise manner.

Figure 4:
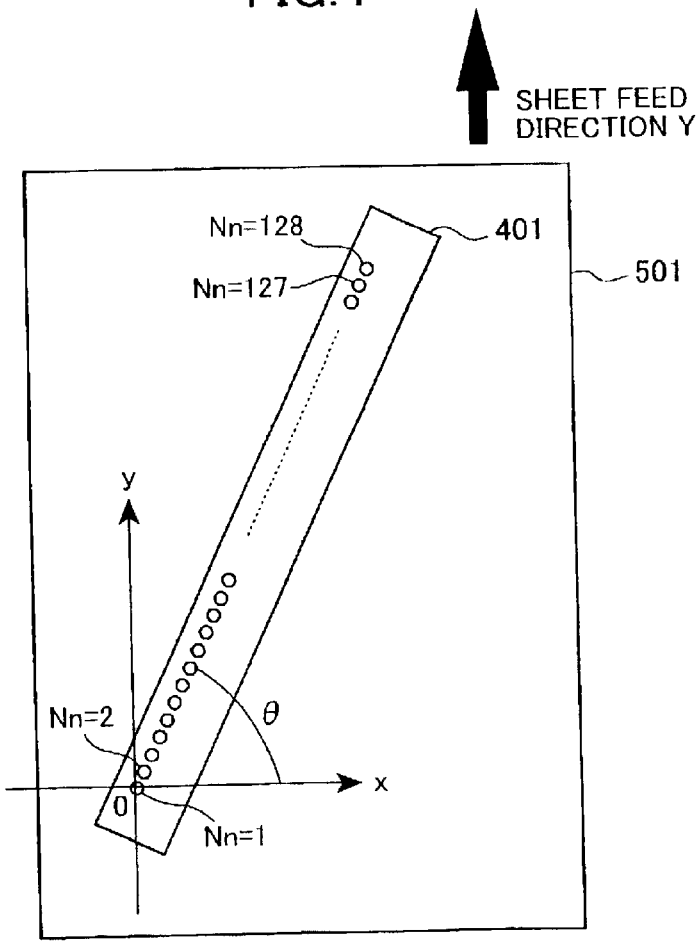
FIG. 4 is an explanatory plan view of a recording head of the inkjet recording device.

The recording head 501 includes a nozzle module 401 and a plurality of piezoelectric-element drivers 402 shown in FIG. 2. In the present embodiment, four piezoelectric-element drivers 402 are provided. Also, as shown in FIG. 4, the nozzle module 401 is arranged such that a nozzle line formed in the nozzle module 401 defines an angle θ with respect to a direction X perpendicular to the sheet feed direction Y. The angle θ is changeable as desired by using the rotary stage 154. Although the rotary stage 154 could be manually controlled, the rotary stage 154 used in the present embodiment is of the type that is automatically controlled to rotate to provide a designate angle θ when instructed by a user. Because the rotary stage 154 has a well-known configuration, detailed descriptions thereof will be omitted.

As shown in FIG. 2, the inkjet recording device 1 further includes a buffer memory 102, a data processing device 103, such as a central processing unit (CPU), an ejection memory 105, a rotary-stage controller 153, a timing controller 106, an analog-driving-signal generation unit 110, and a digital-ejection-signal generation unit 111. A computer system not shown in the drawings is connected to the inkjet recording device 1. Brief description of these components will be provided next.

The buffer memory 102 is for temporarily storing bitmap data 101 received from the computer system. The bitmap data 101 is a monochromatic single bit data indicating "record" when its value is "1" and "not-record" when its value is "0". The bitmap data 101 includes information on resolution designated by a user. This information on resolution is input into the data processing device 103 as resolution information 151. In addition to the resolution information 151, positional-precision information 152 from the computer system and the bitmap data 101 from the buffer memory 102 are input to the data processing device 103. Based on these information, the data processing device 103 calculates the angle θ of the nozzle module 401, a sheet-feed speed vp, and a recording frequency f, and also generates ejection data 104. The rotary-stage controller 153 controls the rotary stage 154 based on the angle θ calculated by the data processing device 103. The ejection memory 105 is for storing the ejection data 104.

The timing controller 106 outputs a driving command 107 to the sheet feed mechanism 601, commanding to start transporting the continuous recording sheet 602, and also receives the sheet-position indication pulse 108 from the rotary encoder 605. The timing controller 106 generates a pixel-synchronization signal 109 in synchronization with the sheet-position indication pulse 108 and outputs the same to the analog-driving-signal generation unit 110. At the same time, the timing controller 106 generates a shift-clock S-CLK and a latch clock L-CLK based on the pixel-synchronization signal 109 by using a theoretical circuit. The shift-clock S-CLK is output to the ejection memory 105 and the digital-ejection-signal generation unit 111, and the latch clock L-CLK is output to the analog-driving-signal generation unit 110. The shift-clock S-CLK and the latch clock L-CLK are also output to each piezoelectric-element driver 402 of the recording head 501.

The analog-driving-signal generation unit 110 is for generating an analog driving signal 406, and, although not shown in the drawings, includes a 10-bit line memory (FIFO), a 10-bit digital-analog (DA) converter, an amplifying transistor, all are well-known in the art. Time-series 10-bit digital data corresponding to the analog driving signal 406 is previously stored in the 10-bit line memory (FIFO) When the latch clock L-CLK is input to the analog-driving-signal generation unit 110, the 10-bit digital data is sequentially retrieved in synchronization with a clock provided to the 10-bit line memory (FIFO) and is converted to the analog driving signal 406 by the 10-bit DA converter and the amplifying transistor. Thus obtained analog driving signal 406 is output to the piezoelectric-element drivers 402-1, 402-2, 402-3, 402-4. The analog driving signal 406 of the present embodiment is a signal including identical trapezoid waveforms occurring once every 40 $\mu$s (see FIG. 7).

The digital-ejection-signal generation unit 111 retrieves the ejection data 104 from the ejection memory 105 in synchronization with the shift-clock S-CLK, amplifies (buffers) the retrieved ejection data 104 to generate a digital ejection signal 407, and serially transfers the digital ejection signal 407 to each piezoelectric-element driver 402.

Figure 5:
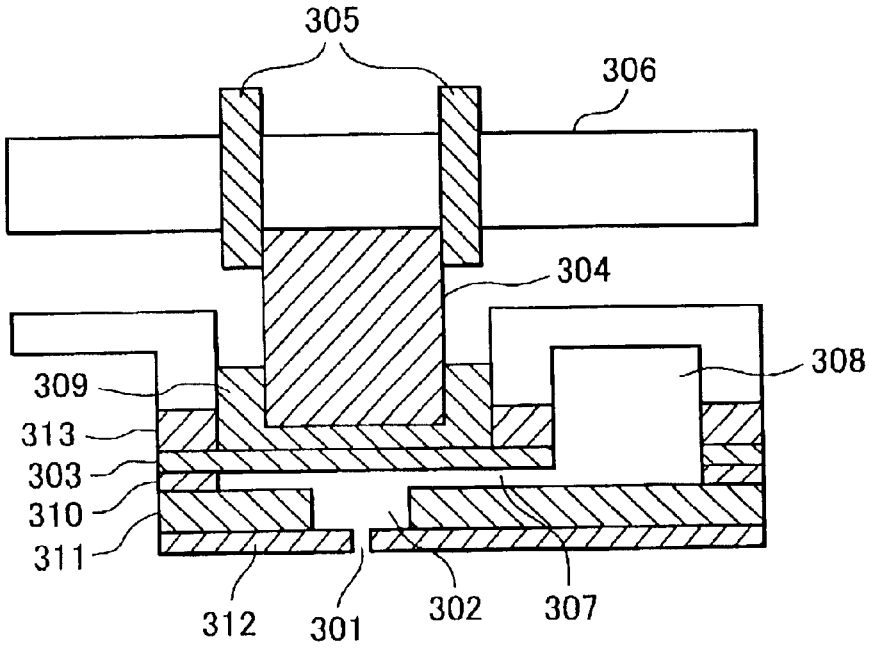
FIG. 5 is a cross-sectional view of one of nozzles formed in a nozzle module of the recording head.

Next, the nozzle module 401 of the recording head 501 will be described while referring to FIG. 5. FIG. 5 shows a cross-sectional view of the nozzle module 401. The nozzle module 401 is formed with a plurality of nozzles 300 (only one nozzle is shown in FIG. 5) and a common ink channel 308 for distributing ink to each nozzle 300, and includes an orifice plate 312, a restrictor plate 310, a pressure-chamber plate 311, and a substrate 306. Each nozzle 300 includes an orifice 301 formed in the orifice plate 312, a pressure chamber 302 defined by the pressure-chamber plate 311, and a restrictor 307 defined by the restrictor plate 310. The restrictor 307 is for connecting the common ink channel 308 to the pressure chamber 302 and regulates ink flow into the pressure chamber 302.

Each nozzle 300 is provided with a diaphragm 303, a piezoelectric element 304, and a supporting plate 313. The piezoelectric element 304 is attached to the diaphragm 303 by a resilient material 309, such as silicon adhesive. The piezoelectric element 304 has a pair of signal-input terminals 305. When a voltage is applied to the signal-input terminal 305, then the piezoelectric element 304 deforms to contract. Otherwise the piezoelectric element 304 maintains its original shape. The supporting plate 313 reinforces the diaphragm 303.

The diaphragm 303, the restrictor plate 310, the pressure-chamber plate 311, the supporting plate 313 are all formed of, for example, stainless steel. The orifice plate 312 is formed of nickel, for example. The substrate 306 is formed of insulation material, such as ceramics or polyimide.

With this configuration, ink supplied from an ink tank (not shown) is distributed into each restrictor 307 through the common ink channel 308 and supplied to the pressure chamber 302 and the orifice 301. The analog driving signal 406 is input to the signal-input terminal 305 at an ejection timing in a manner described later, so that the piezoelectric element 304 deforms to eject a portion of ink inside the pressure chamber 302 through the orifice 301 as an ink droplet.

Figure 6:
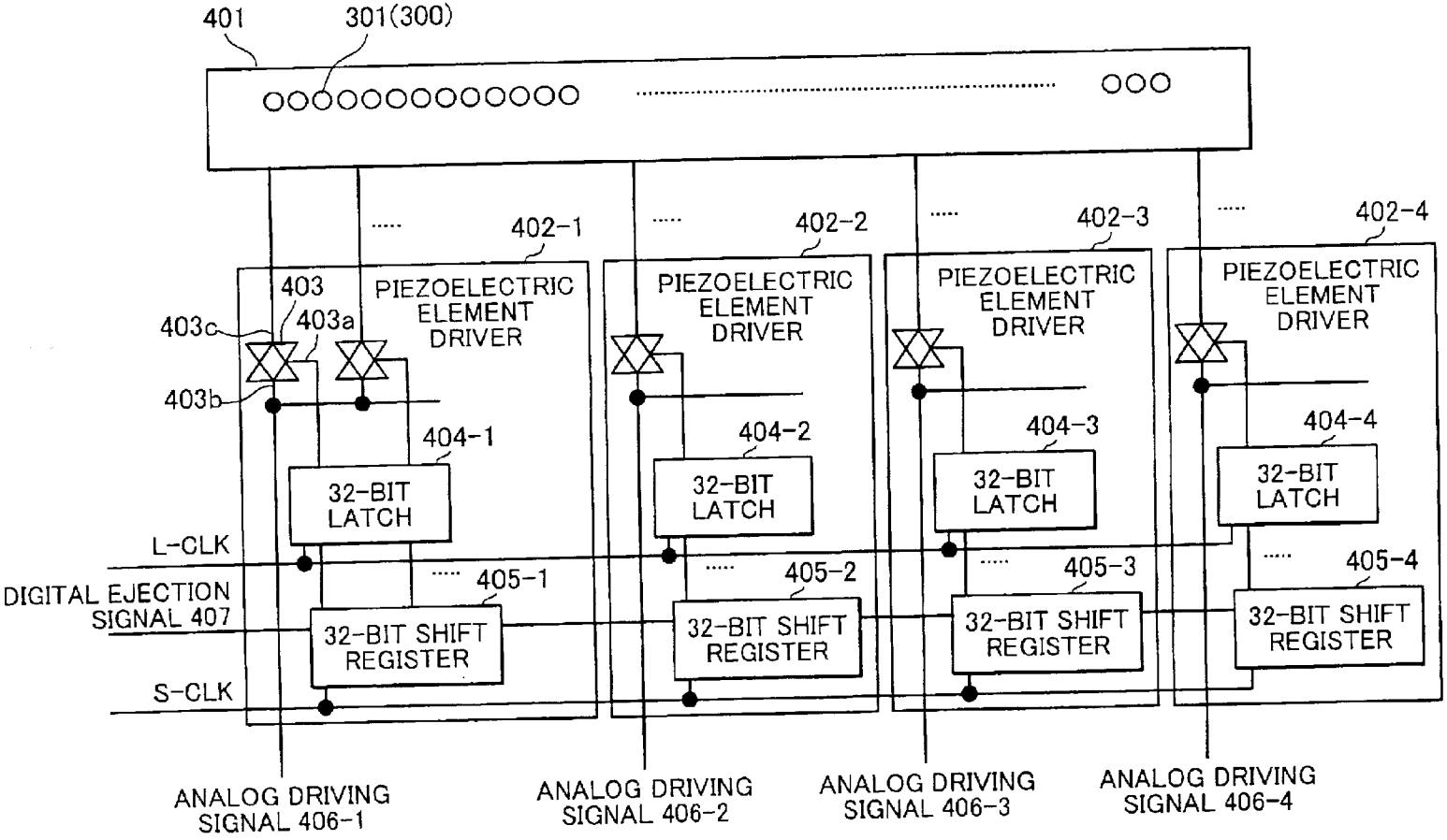
FIG. 6 is a block-diagram showing components of the piezoelectric-element drivers.

In the present embodiment, as shown in FIG. 6, 128-number of nozzles 300 aligned with equidistance from each other are formed in the nozzle module 401. A nozzle pitch (nozzle density) is 75 nozzles per inch (npi). A total length of the nozzle line including the 128-number of nozzles 300 is approximately 43 mm.

Next, the piezoelectric-element drivers 402 will be described. As shown in FIG. 6, four piezoelectric-element drivers 402-1 to 402-4 are provided in this example. Each piezoelectric-element driver 402 corresponds to 32-number of nozzles 300 (128/4) of the 128-number of nozzles 300. Each piezoelectric-element driver 402 includes 32 analog switches 403, a 32-bit latch 404, and a 32-bit shift register 405. The shift-clock S-CLK from the timing controller 106 is input to the 32-bit shift register 405 of each piezoelectric-element driver 402. 128-bit parallel data from the 32-bit shift register 405 and the latch clock L-CLK from the timing controller 106 are input to the 32-bit latch 404.

The digital ejection signal 407 from the digital-ejection-signal generation unit 111 is input to the 32-bit shift register 405-1 of the piezoelectric-element driver 402-1. The digital ejection signal 407 is 128-bit serial data corresponding to the 128-number of nozzles 300 and shifts by a single bit at one time from the 32-bit shift register 405-1 to the 32-bit shift registers 405-2, 405-3, and 405-4 in this order. Here, the digital ejection signal 407 having a value of "1" indicates "ejection", and that having a value of "0" indicates "non-ejection".

Figure 7:
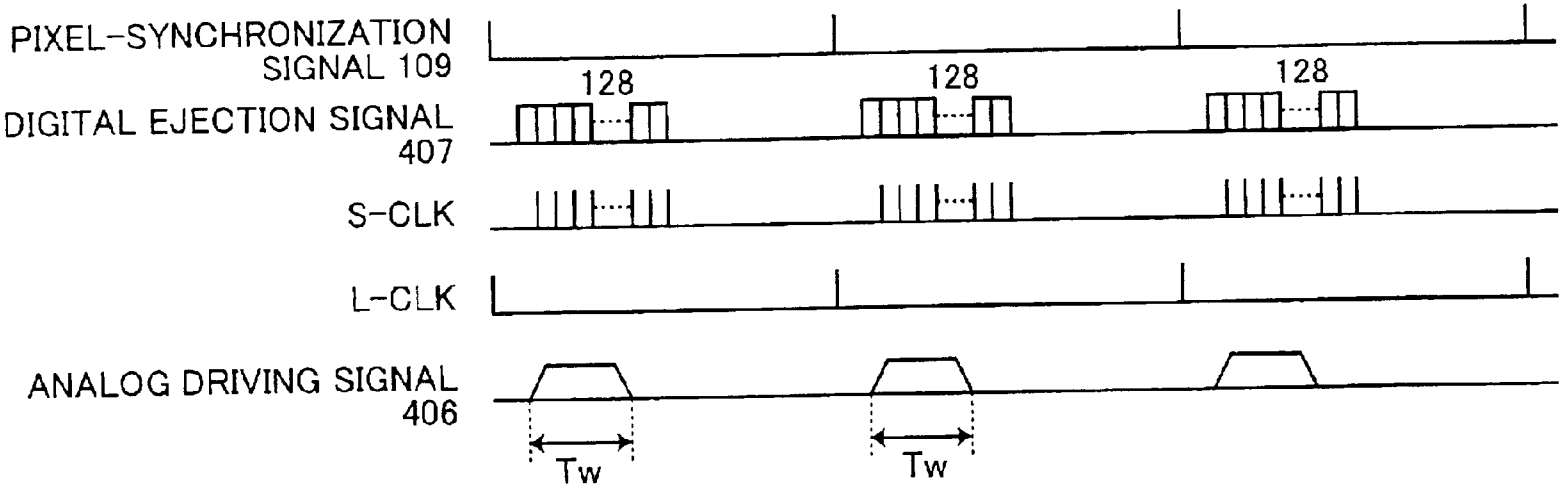
FIG. 7 is a timing chart of a conventional piezoelectric-element driver.

The analog switch 403 has a switch terminal 403*a*, an input terminal 403*b*, and an output terminal 403*c*. An output from the 32-bit latch 404 is input to the switch terminal 403*a* of each analog switches 403, and the analog driving signal 406 is input to the input terminal 403*b* of each analog switch 403. When the analog driving signal 406 is input to the input terminal 403*b* while the digital ejection signal 407 having the value "1" is input to the switch terminal 403*a*, then the analog driving signal 406 is output through the output terminal 403*c*. On the other hand, when the digital ejection signal 407 of the value "0" is input to the switch terminal 403*a*, the output terminal 403*c* is opened, so that no analog driving signal 406 is output through the output terminal 403*c*. The analog driving signal 406 output through the output terminal 403*c* is input to one of the signal-input terminals 305 of the corresponding nozzle 300. Here, another one of the signal-input terminals 305 is grounded. That is, the analog driving signal 406 is commonly used for the corresponding 32-number of nozzles 300 so as to selectively drive the 32-number of nozzles 300. There are various driving waveforms that could be used for the analog driving signal 406. In this embodiment, a 24-V trapezoid waveform having a time width Tw of 5 μs to 25 μs shown in FIG. 7 is used for the analog driving signal 406.

Here, in order to facilitate the explanation, conventional operations of the piezoelectric-element driver 402 will be described with reference to the timing chart of FIG. 7. Here, a time period from when a pixel-synchronization signal 109 is generated until when a subsequent pixel-synchronization signal 109 is generated is considered defining a cycle, and this cycle is repeated. Because the pixel-synchronization signal 109 is generated once each time the continuous recording sheet 602 is transported by one-pixel worth of distance, fluctuation in sheet transporting speed usually fluctuates a time duration of the cycle.

When a pixel-synchronization signal 109 is generated, the latch clock L-CLK is generated. Then, digital ejection signals 407 which have been stored in the 32-bit shift registers 405-1 to 405-4 during a previous cycle are all output to the switch terminals 403*a* through the latches 404-1 to 404-4 at once. At the same time, the analog driving signals 406-1 to 406-4 are output to the switch terminals 403*a*. As a result, ink droplets are ejected from those nozzles 300 whose digital ejection signals 407 have the value of "1", and no ink droplets are ejected from those nozzles whose digital ejection signal 407 have the value of "0". Then, subsequent digital ejection signals 407 are input to the registers 405 and shift by a single bit at a time towards the 32-bit shift register 405-4 in synchronization with the shift-clocks S-CLK. When 128-number of digital ejection signals 407 are stored in the shift registers 405, the present cycle is completed, and the process waits until a next pixel-synchronization signal 109 is generated. That is, the digital ejection signals 407 stored in the shift registers 405 indicate ejection status of a next cycle.

Next, a relationship between the angle θ of the nozzle module 401 and a resolution R will be described while referring to FIG. 4. FIG. 4 shows the nozzle module 401 and a x-y coordinate system having a y axis parallel to the sheet feed direction Y in order to facilitate explanation. In the present embodiment, the nozzle module 401 pivots about a lowermost one of the 128-number of orifices 301 as viewed in FIG. 4 to provide a desired angle θ with respect to the direction X.

The nozzles 300 (orifices 301) are numbered from 1 to 128 beginning from the lowermost nozzle 300. That is, the nozzle 300 located on the original is a nozzle Nn=1, and an uppermost nozzle is a nozzle Nn=128. In this manner, each nozzle is expressed as a nozzle Nn=i (i=1, 2, 3, . . . , 128).

Because the nozzle pitch is 75 npi (nozzle resolution=75 dpi) in the present embodiment, a recording resolution Rx (dpi) with respect to the direction X is calculated using a formula 1:

$$Rx=75/\cos\theta \qquad \text{(formula 1)}$$

That is, by adjusting the angle θ in accordance with a resolution Rx designated by a user, the designated resolution Rx is easily achieved.

On the other hand, a recording resolution Ry (dpi) with respect to the sheet feed direction Y is calculated by a formula 2:

$$Ry=25.4\times(f/vp) \qquad \text{(formula 2)}$$

wherein, f indicates the recording frequency (kHz) of the nozzle 300, and vp indicates the sheet-feed speed (m/s).

Here, if recording operation is performed with this configuration, ink droplets ejected from thus angled nozzle module 401 will impinge out of target lattice points defined on the coordinate system on a recording sheet. This is because ejection timing (phase) differs among the nozzles 300 although the recording frequency f is the same among the nozzles 300. That is, because the recording operation is performed by impinging ink droplets on selected lattice points, if all the nozzles 300 performs ink ejection at the same timing, then it is necessary that the orifices 301 of all the nozzles 300 have the same positional phase with respect to the corresponding target lattice points. However, changing the resolution R and thus the angle θ shifts the locations of target lattice points and also the locations of the orifices 301 with respect to the sheet feed direction Y. Accordingly, the positional phase of the nozzle 300 with respect to target lattice points also changes. Accordingly, one orifice 301 is not on a target lattice point at the time of when a different orifice 301 is located on a target lattice point. However, because a single analog driving signal 406 that determines ejection timing is used in common for corresponding 32-number of nozzles 300, the ejection timing of these 32-number of nozzles 300 is the same. It is not possible to differ the ejection timing among these 32-number of nozzles 300.

The present embodiment overcomes the above problems in a following manner and enables to form recording dots on appropriate locations using all the nozzles 300. Detailed description will be provided next while referring to a specific example.

In FIG. 2, first, a single-job worth (plural-page worth) of bitmap data 101 sequentially output from the computer system is temporarily stored in the buffer memory 102, and at the same time the resolution information 151 and the positional-precision information 152 are input to the data processing device 103. The resolution information 151 indicates a pixel resolution R designated by a user, and the positional-precision information 152 indicates a maximum error designated by the user. The maximum error indicates a maximum amount of positional error of a recorded dot with respect to the sheet feed direction Y (y). In this example, the pixel resolution R is selected to 105 dpi, and the maximum error is selected to ±5 μm or less.

TABLE 1

| | | | |
|---|---|---|---|
| PIXEL RESOLUTION | R | 105 dpi | 241.905 μm |
| PIXEL-DIVING NUMBER | Nsp | 22 | |
| SUB-PIXEL RESOLUTION | Rsp | 2310 dpi | 10.996 μm |
| NOZZLE PITCH | Rn | 75 dpi (npi) | 338.667 μm |

TABLE 1-continued

| | | | |
|---|---|---|---|
| ANGLE | θ | 44.415° | tan θ = 0.9797959 |
| DRIVING-WAVEFORM'S TIME WIDTH | Tw | 40.00 μs | |
| DRIVING FREQUENCY | f | 1.14 KHz | |
| SHEET FEED SPEED | vp | 0.27 m/s | |

TABLE 2

| | NOZZLE POSITION | | LOCATION IN Y DIRECTION | | | | |
|---|---|---|---|---|---|---|---|
| NOZZLE No. Nn | X DIRECTION (μm) | Y DIRECTION (μm) | SUB-PIXEL REAL NUMBER (dot) | SUB-PIXEL INTEGER NUMBER Nsi (dot) | PIXEL No. Np | SUB-PIXEL No. IN PIXEL Ns | POSITIONAL ERROR IN Y DIRECTION (μm) |
| 1 | 0 | 0.0 | 0.00 | 0 | 0 | 0 | 0.0 |
| 2 | 242 | 237.0 | 21.56 | 22 | 1 | 0 | −4.9 |
| 3 | 484 | 474.0 | 43.11 | 43 | 1 | 21 | 1.2 |
| 4 | 726 | 711.1 | 64.67 | 65 | 2 | 21 | −3.7 |
| 5 | 968 | 948.1 | 86.22 | 86 | 3 | 20 | 2.4 |
| 6 | 1210 | 1185.1 | 107.78 | 108 | 4 | 20 | −2.4 |
| 7 | 1451 | 1422.1 | 129.33 | 129 | 5 | 19 | 3.7 |
| 8 | 1693 | 1659.1 | 150.89 | 151 | 6 | 19 | −1.2 |
| 9 | 1935 | 1896.1 | 172.44 | 172 | 7 | 18 | 4.9 |
| 10 | 2177 | 2133.2 | 194.00 | 194 | 8 | 18 | 0.0 |
| 11 | 2419 | 2370.2 | 215.56 | 216 | 9 | 18 | −4.9 |
| 12 | 2661 | 2607.2 | 237.11 | 237 | 10 | 17 | 1.2 |
| 13 | 2903 | 2844.2 | 258.67 | 259 | 11 | 17 | −3.7 |
| 14 | 3145 | 3081.2 | 280.22 | 280 | 12 | 16 | 2.4 |
| 15 | 3387 | 3318.2 | 301.78 | 302 | 13 | 16 | −2.5 |
| 16 | 3629 | 3555.3 | 323.33 | 323 | 14 | 15 | 3.7 |
| 17 | 3870 | 3792.3 | 344.89 | 345 | 15 | 15 | −1.2 |
| 18 | 4112 | 4029.3 | 366.44 | 366 | 16 | 14 | 4.9 |
| 19 | 4354 | 4266.3 | 388.00 | 388 | 17 | 14 | 0.0 |
| 20 | 4596 | 4503.3 | 409.55 | 410 | 18 | 14 | −4.9 |
| 21 | 4838 | 4740.3 | 431.11 | 431 | 19 | 13 | 1.2 |
| 22 | 5080 | 4977.4 | 452.67 | 453 | 20 | 13 | −3.7 |
| 23 | 5322 | 5214.4 | 474.22 | 474 | 21 | 12 | 2.4 |
| 24 | 5564 | 5451.4 | 495.78 | 496 | 22 | 12 | −2.5 |
| 25 | 5806 | 5688.4 | 517.33 | 517 | 23 | 11 | 3.7 |
| 26 | 6048 | 5925.4 | 538.89 | 539 | 24 | 11 | −1.2 |
| 27 | 6290 | 6162.4 | 560.44 | 560 | 25 | 10 | 4.9 |
| 28 | 6531 | 6399.5 | 582.00 | 582 | 26 | 10 | 0.0 |
| 29 | 6773 | 6636.5 | 603.55 | 604 | 27 | 10 | −4.9 |
| 30 | 7015 | 6873.5 | 625.11 | 625 | 28 | 9 | 1.2 |
| 31 | 7257 | 7110.5 | 646.67 | 647 | 29 | 9 | −3.7 |
| 32 | 7499 | 7347.5 | 668.22 | 668 | 30 | 8 | 2.4 |
| 33 | 7741 | 7584.6 | 689.78 | 690 | 31 | 8 | −2.5 |
| 34 | 7983 | 7821.6 | 711.33 | 711 | 32 | 7 | 3.6 |
| 35 | 8225 | 8058.6 | 732.89 | 733 | 33 | 7 | −1.2 |
| 36 | 8467 | 8295.6 | 754.44 | 754 | 34 | 6 | 4.9 |
| 37 | 8709 | 8532.6 | 776.00 | 776 | 35 | 6 | 0.0 |
| 38 | 8950 | 8769.6 | 797.55 | 798 | 36 | 6 | −4.9 |
| 39 | 9192 | 9006.7 | 819.11 | 819 | 37 | 5 | 1.2 |
| 40 | 9434 | 9243.7 | 840.66 | 841 | 38 | 5 | −3.7 |
| 41 | 9676 | 9480.7 | 862.22 | 862 | 39 | 4 | 2.4 |
| 42 | 9918 | 9717.7 | 883.78 | 884 | 40 | 4 | −2.5 |
| 43 | 10160 | 9954.7 | 905.33 | 905 | 41 | 3 | 3.6 |
| 44 | 10402 | 10191.7 | 926.89 | 927 | 42 | 3 | −1.2 |
| 45 | 10644 | 10428.8 | 948.44 | 948 | 43 | 2 | 4.9 |
| 46 | 10886 | 10665.8 | 970.00 | 970 | 44 | 2 | 0.0 |
| 47 | 11128 | 10902.8 | 991.55 | 992 | 45 | 2 | −4.9 |
| 48 | 11370 | 11139.8 | 1013.11 | 1013 | 46 | 1 | 1.2 |
| 49 | 11611 | 11376.8 | 1034.66 | 1035 | 47 | 1 | −3.7 |
| 50 | 11853 | 11613.8 | 1056.22 | 1056 | 48 | 0 | 2.4 |
| 51 | 12095 | 11850.9 | 1077.78 | 1078 | 49 | 0 | −2.5 |
| 52 | 12337 | 12087.9 | 1099.33 | 1099 | 49 | 21 | 3.6 |
| 53 | 12579 | 12324.9 | 1120.89 | 1121 | 50 | 21 | −1.2 |
| 54 | 12821 | 12561.9 | 1142.44 | 1142 | 51 | 20 | 4.9 |
| 55 | 13063 | 12798.9 | 1164.00 | 1164 | 52 | 20 | 0.0 |
| 56 | 13305 | 13036.0 | 1185.55 | 1186 | 53 | 20 | −4.9 |

TABLE 2-continued

| | NOZZLE POSITION | | LOCATION IN Y DIRECTION | | | | |
|---|---|---|---|---|---|---|---|
| | | | SUB-PIXEL | SUB-PIXEL | | SUB-PIXEL | POSITIONAL |
| NOZZLE No. Nn | X DIRECTION (μm) | Y DIRECTION (μm) | REAL NUMBER (dot) | INTEGER NUMBER Nsi (dot) | PIXEL No. Np | No. IN PIXEL Ns | ERROR IN Y DIRECTION (μm) |
| 57 | 13547 | 13273.0 | 1207.11 | 1207 | 54 | 19 | 1.2 |
| 58 | 13789 | 13510.0 | 1228.66 | 1229 | 55 | 19 | −3.7 |
| 59 | 14030 | 13747.0 | 1250.22 | 1250 | 56 | 18 | 2.4 |
| 60 | 14272 | 13984.0 | 1271.78 | 1272 | 57 | 18 | −2.5 |
| 61 | 14514 | 14221.0 | 1293.33 | 1293 | 58 | 17 | 3.6 |
| 62 | 14756 | 14458.1 | 1314.89 | 1315 | 59 | 17 | −1.3 |
| 63 | 14998 | 14695.1 | 1336.44 | 1336 | 60 | 16 | 4.9 |
| 64 | 15240 | 14932.1 | 1358.00 | 1358 | 61 | 16 | 0.0 |
| | | | | | | MAXIMUM | 4.9 |
| | | | | | | MINIMUM | −4.9 |
| 65 | 15482 | 15169.1 | 1379.55 | 62 | 1380 | 16 | −4.9 |
| 66 | 15724 | 15406.1 | 1401.11 | 63 | 1401 | 15 | 1.2 |
| 67 | 15966 | 15643.1 | 1422.66 | 64 | 1423 | 15 | −3.7 |
| 68 | 16208 | 15880.2 | 1444.22 | 65 | 1444 | 14 | 2.4 |
| 69 | 16450 | 16117.2 | 1465.77 | 66 | 1466 | 14 | −2.5 |
| 70 | 16691 | 16354.2 | 1487.33 | 67 | 1487 | 13 | 3.6 |
| 71 | 16933 | 16591.2 | 1508.89 | 68 | 1509 | 13 | −1.3 |
| 72 | 17175 | 16828.2 | 1530.44 | 69 | 1530 | 12 | 4.9 |
| 73 | 17417 | 17065.2 | 1552.00 | 70 | 1552 | 12 | 0.0 |
| 74 | 17659 | 17302.3 | 1573.55 | 71 | 1574 | 12 | −4.9 |
| 75 | 17901 | 17539.3 | 1595.11 | 72 | 1595 | 11 | 1.2 |
| 76 | 18143 | 17776.3 | 1616.66 | 73 | 1617 | 11 | −3.7 |
| 77 | 18385 | 18013.3 | 1638.22 | 74 | 1638 | 10 | 2.4 |
| 78 | 18627 | 18250.3 | 1659.77 | 75 | 1660 | 10 | −2.5 |
| 79 | 18869 | 18487.3 | 1681.33 | 76 | 1681 | 9 | 3.6 |
| 80 | 19110 | 18724.4 | 1702.89 | 77 | 1703 | 9 | −1.3 |
| 81 | 19352 | 18961.4 | 1724.44 | 78 | 1724 | 8 | 4.8 |
| 82 | 19594 | 19198.4 | 1746.00 | 79 | 1746 | 8 | 0.0 |
| 83 | 19836 | 19435.4 | 1767.55 | 80 | 1768 | 8 | −4.9 |
| 84 | 20078 | 19672.4 | 1789.11 | 81 | 1789 | 7 | 1.2 |
| 85 | 20320 | 19909.5 | 1810.66 | 82 | 1811 | 7 | −3.7 |
| 86 | 20562 | 20146.5 | 1832.22 | 83 | 1832 | 6 | 2.4 |
| 87 | 20804 | 20383.5 | 1853.77 | 84 | 1854 | 6 | −2.5 |
| 88 | 21046 | 20620.5 | 1875.33 | 85 | 1875 | 5 | 3.6 |
| 89 | 21288 | 20857.5 | 1896.88 | 86 | 1897 | 5 | −1.3 |
| 90 | 21530 | 21094.5 | 1918.44 | 87 | 1918 | 4 | 4.8 |
| 91 | 21771 | 21331.6 | 1940.00 | 88 | 1940 | 4 | 0.0 |
| 92 | 22013 | 21568.6 | 1961.55 | 89 | 1962 | 4 | −4.9 |
| 93 | 22255 | 21805.6 | 1983.11 | 90 | 1983 | 3 | 1.2 |
| 94 | 22497 | 22042.6 | 2004.66 | 91 | 2005 | 3 | −3.7 |
| 95 | 22739 | 22279.6 | 2026.22 | 92 | 2026 | 2 | 2.4 |
| 96 | 22981 | 22516.6 | 2047.77 | 93 | 2048 | 2 | −2.5 |
| 97 | 23223 | 22753.7 | 2069.33 | 94 | 2069 | 1 | 3.6 |
| 98 | 23465 | 22990.7 | 2090.88 | 95 | 2091 | 1 | −1.3 |
| 99 | 23707 | 23227.7 | 2112.44 | 96 | 2112 | 0 | 4.8 |
| 100 | 23949 | 23464.7 | 2134.00 | 96 | 2134 | 22 | 0.0 |
| 101 | 24190 | 23701.7 | 2155.55 | 97 | 2156 | 22 | −4.9 |
| 102 | 24432 | 23938.7 | 2177.11 | 98 | 2177 | 21 | 1.2 |
| 103 | 24674 | 24175.8 | 2198.66 | 99 | 2199 | 21 | −3.7 |
| 104 | 24916 | 24412.8 | 2220.22 | 100 | 2220 | 20 | 2.4 |
| 105 | 25158 | 24649.8 | 2241.77 | 101 | 2242 | 20 | −2.5 |
| 106 | 25400 | 24886.8 | 2263.33 | 102 | 2263 | 19 | 3.6 |
| 107 | 25642 | 25123.8 | 2284.88 | 103 | 2285 | 19 | −1.3 |
| 108 | 25884 | 25360.9 | 2306.44 | 104 | 2306 | 18 | 4.8 |
| 109 | 26126 | 25597.9 | 2328.00 | 105 | 2328 | 18 | −0.1 |
| 110 | 26368 | 25834.9 | 2349.55 | 106 | 2350 | 18 | −4.9 |
| 111 | 26610 | 26071.9 | 2371.11 | 107 | 2371 | 17 | 1.2 |
| 112 | 26851 | 26308.9 | 2392.66 | 108 | 2393 | 17 | −3.7 |
| 113 | 27093 | 26545.9 | 2414.22 | 109 | 2414 | 16 | 2.4 |
| 114 | 27335 | 26783.0 | 2435.77 | 110 | 2436 | 16 | −2.5 |
| 115 | 27577 | 27020.0 | 2457.33 | 111 | 2457 | 15 | 3.6 |
| 116 | 27819 | 27257.0 | 2478.88 | 112 | 2479 | 15 | −1.3 |
| 117 | 28061 | 27494.0 | 2500.44 | 113 | 2500 | 14 | 4.8 |
| 118 | 28303 | 27731.0 | 2521.99 | 114 | 2522 | 14 | −0.1 |
| 119 | 28545 | 27968.0 | 2543.55 | 115 | 2544 | 14 | −4.9 |
| 120 | 28787 | 28205.1 | 2565.11 | 116 | 2565 | 13 | 1.2 |
| 121 | 29029 | 28442.1 | 2586.66 | 117 | 2587 | 13 | −3.7 |
| 122 | 29270 | 28679.1 | 2608.22 | 118 | 2608 | 12 | 2.4 |
| 123 | 29512 | 28916.1 | 2629.77 | 119 | 2630 | 12 | −2.5 |
| 124 | 29754 | 29153.1 | 2651.33 | 120 | 2651 | 11 | 3.6 |

TABLE 2-continued

| | NOZZLE POSITION | | LOCATION IN Y DIRECTION | | | | |
|---|---|---|---|---|---|---|---|
| | | | SUB-PIXEL | SUB-PIXEL | | SUB-PIXEL | POSITIONAL |
| NOZZLE No. Nn | X DIRECTION (μm) | Y DIRECTION (μm) | REAL NUMBER (dot) | INTEGER NUMBER Nsi (dot) | PIXEL No. Np | No. IN PIXEL Ns | ERROR IN Y DIRECTION (μm) |
| 125 | 29996 | 29390.1 | 2672.88 | 121 | 2673 | 11 | −1.3 |
| 126 | 30238 | 29627.2 | 2694.44 | 122 | 2694 | 10 | 4.8 |
| 127 | 30480 | 29864.2 | 2715.99 | 123 | 2716 | 10 | −0.1 |
| 128 | 30722 | 30101.2 | 2737.55 | 124 | 2738 | 10 | −5.0 |
| | | | | | | MAXIMUM | 4.9 |
| | | | | | | MINIMUM | −5.0 |

Then a minimum pixel-dividing number N(min) is selected based on the resolution information 151 and the positional-precision information 152 with reference to a table showing relationships among the pixel resolution R, impinge position preciseness, and the minimum pixel-dividing number N(min). Such a table is prepared beforehand. In this example, the minimum pixel-dividing number N(min) of 22 is selected. It should be noted that the positional error indicates a positional error due to change in the resolution R and in the angle θ in association with the change in the resolution R, and no other factors that might cause such positional error will be taken into consideration.

Figure 8:
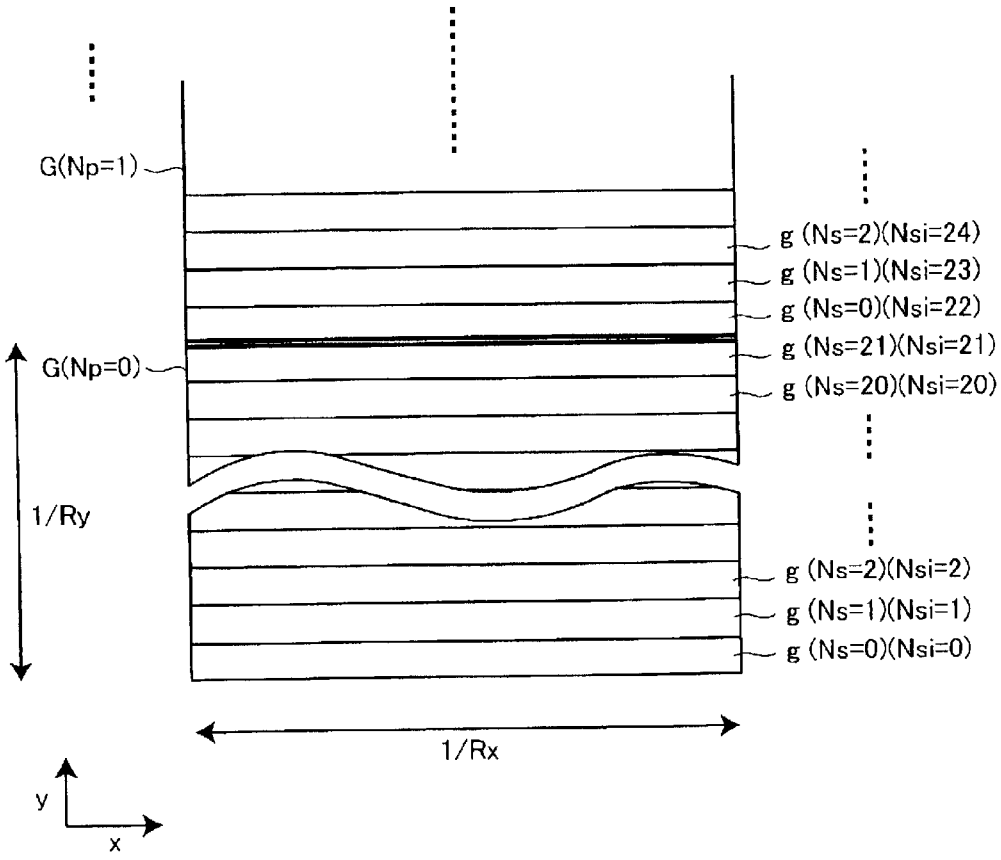
FIG. 8 is an explanatory view showing pixels each having a plurality of sub-pixels.

Detailed description of a pixel G will be provided while referring to FIG. 8. The pixel G is a square area defined by the bitmap data 101. The resolution information 151 determines the size of the pixel G in the directions X and Y. The pixel resolution R (dpi) is a reciprocal number of the size of the pixel G in the directions X and Y, and includes a X resolution Rx and a Y resolution Ry. In this example, it is assumed that "Rx=Ry=R=105 dpi" has been designated. That is, the pixel G has the resolution of 105 dpi in both the directions X and Y, and a single recording dot is formed in a single pixel G.

The pixels G are represented by pixel numbers Np starting from 0, increasing in the direction Y. Also, each pixel G is divided into Nsp number of sub-pixel g in the direction Y. Nsp is called a pixel-dividing number, which is 22 in the present example, i.e., Nsp=Nsp(min)=22. Also, because the Y resolution Ry of the pixel G is 105 dpi, then a resolution of the sub-pixel in the direction Y (sub-pixel resolution Rsp) is 2,310 dpi (105 dpi×22). The sub-pixels g in each pixel G are represented by sub-pixel numbers Ns starting from 0, increasing in the direction Y (Ns=0, 1, 2, . . . ). In the present example, the Ns=0 through 21 since the pixel-dividing number Nsp=22.

The sub-pixels g are represented by sub-pixel integer numbers Nsi (dot) also. The sub-pixel integer numbers Nsi are serial numbers starting from 0, which is assigned to the sub-pixel Ns=0 of the pixel Np=0 on the original. For example, a pixel Np=0 includes 22 sub-pixels Nsi=0, 1, 2, . . . 21, and a pixel Np=i (i=0, 1, 2, . . . ) includes 22 sub-pixels Nsi=22×i, 22×i+1, . . . , 22×i+21.

As described above, when the resolution information 151 and the positional-precision information 152 are input to the data processing device 103, then the data processing device 103 calculates the angle θ based on the resolution information 151, and then output the information on the calculated angle θ to the rotary-stage controller 153. In the present example, the angle θ=44.415° is calculated from the above formula 1. The rotary-stage controller 153 drives the rotary stage 154 based on the calculated angle θ to achieve the angle θ of the nozzle module 401.

Then, the data processing device 103 calculates the sheet-feed speed vp and the recording frequency f based on the positional-precision information 152. Here, a time duration necessary for generating an analog driving signal 406 once is assumingly a time width Tw (μs), which is equal to the time width of the trapezoid waveform of the analog driving signal 406 shown in FIG. 7. Allotting a single driving waveform to each sub-pixel g requires at least a time duration Tw for forming a dot on a single sub-pixel g. Accordingly, a maximum recording frequency f necessary for forming a dot on a single pixel G is calculated using a formula 3.

$$f=1000/(Tw\cdot Nsp(\min))(kHz) \quad \text{(formula 3)}$$

Further, a maximum sheet-feed speed vp (m/s) is calculated using the formula 2. In the present embodiment, the time width Tw of the driving waveform is set to 40 (μs) (Tw=40). Hence, the maximum recording frequency f=1.14 kHz according to the formulas 2 and 3. However, in the present invention, the recording frequency f is set to 1 kHz taking fluctuation in sheet-feed speed vp into consideration. Accordingly, the sheet-feed speed vp=0.24(m/s) in the present example.

Next, a position of each nozzle 300 is calculated using the x-y coordinate system. Here, the position of the nozzle 300 indicates a position of the center of an orifice 301 of the nozzle 300 (orifice center of the nozzle 300), which is expressed using the distance in the direction y from the position of the nozzle Nn=1 on the original, i.e. using a coordinate value (x, y). In addition, the position of the nozzle 300 is also expressed by, as shown in a Table 2, a sub-pixel real number (dot) of the nozzle 300, the sub-pixel integer number Nsi (dot), the pixel number Np, the sub-pixel number Ns, and the y-direction positional error (μs).

In other words, the Table 2 indicates the position of each nozzle Nn=i of when the nozzle Nn=1 is on the original.

The sub-pixel real number represents the location of each nozzle 300 by a term of how many sub-pixel-worth of distance each nozzle is distanced from the original, and is calculated by dividing the distance in the direction y from the original by the size of the sub-pixel g in the direction y. The size of the sub-pixel g in the direction y is 10.996 μm in the present example (see Table 1). By rounding the sub-pixel real number to an integer, the sub-pixel integer number Nsi is obtained. The pixel number Np and the sub-pixel number Ns on which each nozzle locates are easily obtained using the sub-pixel integer number Nsi according to the above relations.

The positional error (μm) with respect to the direction y is a difference between a y coordinate value of the nozzle and a y coordinate value of the center of a sub-pixel g on which the orifice center of the nozzle is located. This is a sampling error of when the y coordinate value of the nozzle center is sampled by the y coordinate value of the center of the sub-pixel g, and corresponds to the preciseness in the impinge position. When the pixel-dividing number Nsp=22 as in this example, the positional error becomes between +4.9 μm to −5.0 μm. This satisfies the positional error of ±5.0 μm or less that is specified by the positional-precision information 152. This value of the positional error decreases as the pixel-dividing number Nsp increases. For example, if the pixel-dividing number Nsp=21 in this example, resultant positional error becomes between +5.6 μm and −5.6 μm (not shown), which do not satisfy the positional error of ±5.0 μm or less. That is, the pixel-dividing number Nsp=22 is the minimum pixel-dividing number Nsp (min) that provides the positional error of ±5.0 μm or less.

In FIG. 2, while or after the bitmap data 101 is stored in the buffer memory 102, the data processing device 103 sequentially converts the bitmap data 101 stored in the buffer memory 102 into the ejection data 104, and stores the ejection data 104 into the ejection memory 105. The conversion of the bitmap data 101 into the ejection data 104 is performed based on a predetermined program in accordance with a configuration of the recording head 501. Details will be described next.

Figure 9:
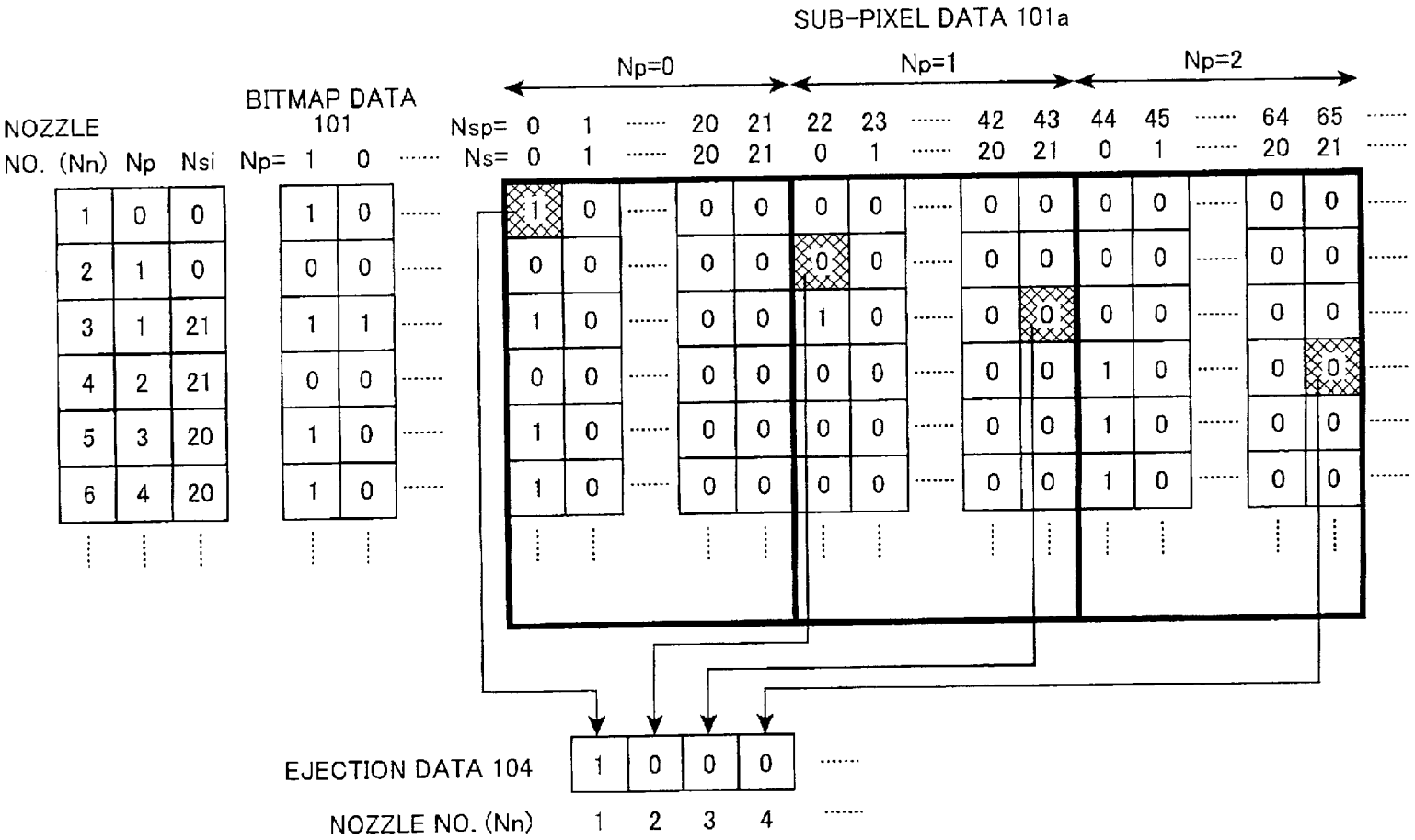
FIG. 9 is an explanatory view of processes of converting bitmap data into ejection data.

As described above, the bitmap data 101 of the present example is a pixel-basis data for resolutions Rx=Ry=R. The bitmap data 101 is first converted into a sub-pixel basis bitmap data (sub-pixel data) 101*a* for the resolution Rx=R and Ry=Rsp. Because the pixel-dividing number Nsp=22 in the present example, 22 sets of sub-pixel data 101*a* are generated for each pixel G. That is, the 22 sets of sub-pixel data 101*a* are for corresponding ones of 22 sub-pixels Ns=0 to 21. This conversion is performed by, as shown in FIG. 9, setting the sub-pixel data 101*a* for sub-pixel Ns=0 to the values of the bitmap data 101, either "0" or "1", and setting the sub-pixel data 101*a* for remaining sub-pixels Ns=1 through 21 to the value of "0".

Next, thus generated sub-pixel data 101*a* is rearranged into a chronological order in a following manner to generate 22 sets of ejection data 104. First, ejection data 104 for when the nozzle Nn=1 is positioned on the sub-pixel g having the sub-pixel integer number Nsi=0, i.e., for when the nozzle Nn=1 is on the original.

When the nozzle Nn=1 is on the original, as shown in the Table 2, Np=0 and Ns=0 for the nozzle Nn=1. Therefore, the ejection data 104 for the nozzle N=1 is set to the value of the sub-pixel data 101*a* for Np=0, Ns=0 of the nozzle Nn=1, which is the value "1" in the example shown in FIG. 9. The remaining nozzles Nn=2 to 128 are positioned on sub-pixels indicated by the sub-pixel integer numbers Nsi in the Table 2. Therefore, the ejection data 104 for these nozzles Nn=2 to 128 is set to the values of sub-pixel data 101*a* for the corresponding sub-pixels and the nozzles. For example, as shown in the Table 2, the nozzle Nn=2 is on the sub-pixel Nsi=22, i.e., Np=1, Ns=0. As shown in FIG. 9, the sub-pixel data 101*a* of Np=1, Ns=0 for the nozzle Nn=2 is "0", so that the ejection data 104 for the nozzle Nn=2 is set to the value "0". Similarly, the nozzle Nn=3 is on the sub-pixel Nsi=43, i.e., Np=1, Ns=21. As shown in FIG. 9, the sub-pixel data 101*a* of Np=1, Ns=21 for the nozzle Nn=3 is "0", so that the ejection data 104 for the nozzle Nn=3 is set to the value "0". In this manner, the ejection data 104 for all the 128-number of nozzles is prepared.

In the same manner, the ejection data 104 for when the nozzle Nn=1 is on the sub-pixels Nsi=1 to 21 is prepared for all the 128-number of nozzles. Here, when the nozzle Nn=1 is on the sub-pixel Nsi=1, for example, then the orifice center of the nozzle Nn=i is located on its sub-pixel Nsi+1. When the ejection data 104 is generated completely for when the nozzle Nn=1 is on the sub-pixel Nsi=0 through 21, then the ejection data 104 is stored in the ejection memory 105.

After storing the ejection data 104 into the ejection memory 105, the timing controller 106 outputs the driving command 107 to the sheet feed mechanism 601, thereby start transporting the continuous recording sheet 602. Then, the rotary encoder 605 of the sheet feed mechanism 601 starts generating the sheet-position indication pulse 108 and outputs the same to the timing controller 106. Upon confirming that the continuous recording sheet 602 reaches a predetermined recording location based on the sheet-position indication pulse 108, the timing controller 106 starts generating the pixel-synchronization signal 109 in synchronization with the sheet-position indication pulse 108. A resolution of the rotary encoder 605 is 1 μm on a recording sheet, so that a predetermined plural number of pixel-synchronization signals 109 are generated each time the sheet-position indication pulse 108 is generated once in such that the pixel-synchronization signal 109 is generated one each time the continuous recording sheet 602 is transported by a single-pixel worth of distance so as to achieve the resolution Ry (105 dpi).

The timing controller 106 generates the latch clock L-CLK and the shift-clock S-CLK using the theoretical circuit based on the pixel-synchronization signal 109. The digital-ejection-signal generation unit 111 retrieves the ejection data 104 from the ejection memory 105 in synchronization with the shift-clock S-CLK, amplifies (buffers) the ejection data 104 to generate the digital ejection signal 407, and serially transmits the digital ejection signal 407 to each piezoelectric-element driver 402.

Figure 10:
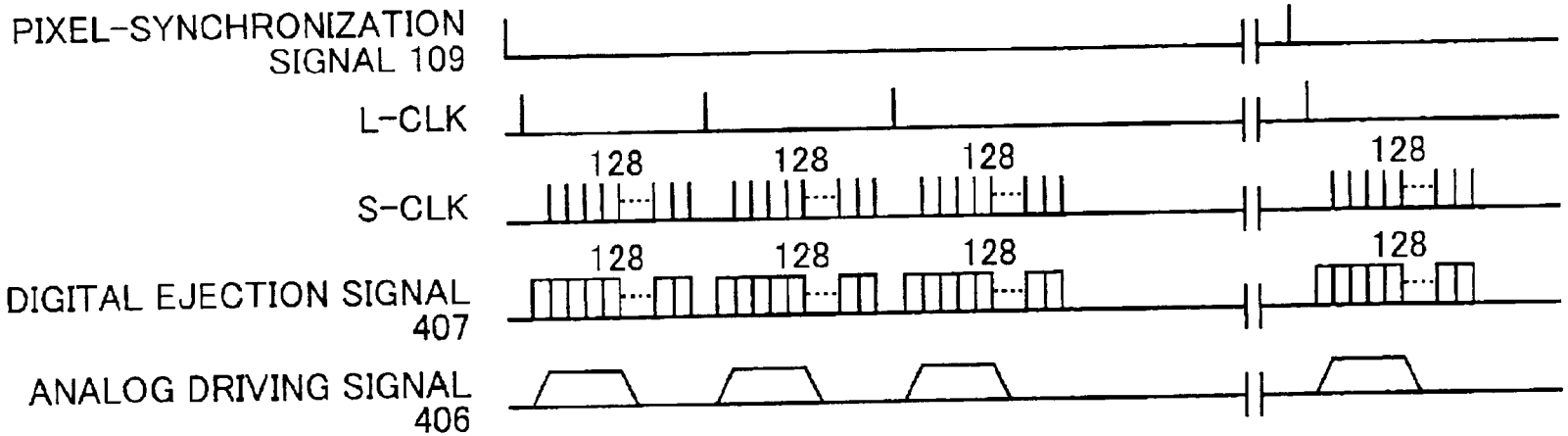
FIG. 10 is a timing chart of the piezoelectric-element driver according to the first embodiment.

Detailed description will be provided with reference to the timing chat shown in FIG. 10. First, the timing controller 106 generates the pixel-synchronization signal 109. As described above, a time period between two successive pixel-synchronization signals 109 defines a single cycle, and the pixel-synchronization signal 109 is generated once each time the continuous recording sheet 602 is transported by a single-pixel worth of distance. Because the recording frequency f=1 kHz as described above, the pixel-synchronization signal 109 has a period of 1 ms. However, the actual period would be 1±0.1 ms due to fluctuation in sheet-feed speed vp. The latch clock L-CLK is generated once every 40 μs, 22 times every time the pixel-synchronization signal 109 is generated once. The shift-clock S-CLK is generated 128 times every time the latch clock L-CLK is generated once. Because latch clock L-CLK of 8 MHs is used in this embodiment, a time width of the shift-clock S-CLK is 125 ns. The digital ejection signal 407 shifts by one bit at a time in synchronization with the shift-clock S-CLK.

The analog-driving-signal generation unit 110 generates the analog driving signal 406 in synchronization with the latch clock L-CLK. As a result, 22 trapezoid waveforms are generated during the single cycle. The first trapezoid waveform is generated when the orifice center of the nozzle Nn=1 reaches the center of the sub-pixel Ns=1. At this time, the orifice center of other nozzles with respect to the direction y is located on the sub-pixel indicated by the sub-pixel number Ns in the Table 2. Because the sub-pixel data 101*a* for the sub-pixel Ns=0 is set to the value of the bitmap data 101 (FIG. 9) as described above, only the nozzles whose orifice center is on the sub-pixel Ns=0 selectively eject ink droplets at this time. That is, as shown in the Table 2, the nozzles 200 whose orifice center is on the sub-pixel Ns=0 at this time are only five nozzles Nn=1, 2, 50, 51, 99. Therefore, five bits of the 128-bit digital ejection signal 407 corresponding to the above five nozzles Nn=1, 2, 50, 51, 99 have a chance to have the value of "1", and the remaining bits are all "0".

The second trapezoid waveform is generated when the continuous recording sheet 602 is transported by one-sub-pixel worth of distance, that is when the orifice center of the nozzle Nn=1 reaches the center of the sub-pixel Ns=1. The orifice center of the remaining nozzles Nn=2 to 128 is located on their sub-pixel Ns+1. At this time, the nozzles having Ns=21 (22−1=21), i.e., six nozzles Nn=3, 4, 52, 53, 100, 101 are on the sub-pixel Ns=0. Therefore, six bits of the 128-bit digital ejection signal 407 corresponding to the above six nozzles Nn=3, 4, 52, 53, 100, 101 have a chance for the value of "1", and the remaining bits are all "0".

After completing the same process for all the 22 sub-pixels (22 trapezoid waveforms), the process waits until the next pixel-synchronization signal 109 is generated.

In this manner, recording operations are preformed for designated recording resolution of 105 dpi and positional error of ±5 μm or less. Also, because the pixel-dividing number Nsp is set to the minimum pixel-dividing number Nsp(min), the sub-pixels g have a maximum possible size, so that the sheet-feed speed vp of 0.24 m/s, which is the maximum speed available when the above designated conditions are satisfied, is achieved.

Figure 11:
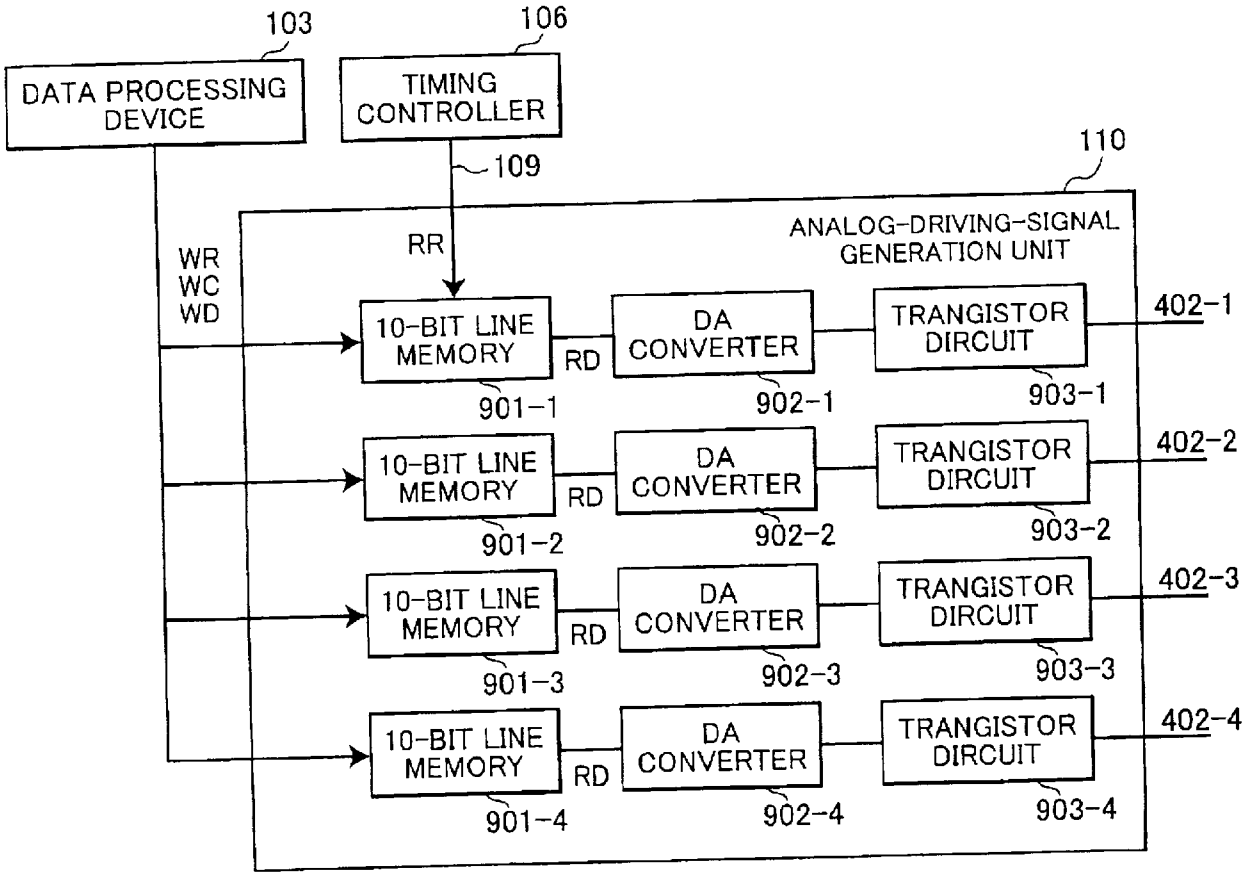
FIG. 11 is a block diagram showing components of an analog-driving-signal generation unit according to a second embodiment of the present invention.

Next, a second embodiment of the present invention will be described while referring to a Table 3, a Table 4, and FIGS. 11 and 12.

TABLE 3

| | | | |
|---|---|---|---|
| PIXEL RESOLUTION | R | 105 dpi | 241.9 μm |
| PIXEL-DIVIDING NUMBER | Dsp | 50 | |
| SUB-PIXEL RESOLUTION | Nsp | 5250 dpi | 4.8 μm |
| NOZZLE PITCH | Rn | 75 dpi | 338.7 μm |
| ANGLE | θ | 44.415 degree | tan θ = 0.979795897 |
| DRIVING WAVEFORM'S TIME WIDTH | Tw | 40.00 μs | |
| DRIVING FREQUENCY | f | 0.50 KHz | |
| SHEET FEED SPEED | vp | 0.12 m/s | |

TABLE 4

| | NOZZLE POSITION | | LOCATION IN Y DIRECTION | | | | |
|---|---|---|---|---|---|---|---|
| NOZZLE No. Nn | X DIRECTION (μm) | Y DIRECTION (μm) | SUB-PIXEL REAL NUMBER (dot) | SUB-PIXEL INTEGER NUMBER Nsi (dot) | PIXEL No. Np | SUB-PIXEL No. IN PIXEL Ns | POSITIONAL ERROR IN Y DIRECTION (μm) |
| 1 | 0 | 0 | 0.0 | 0 | 0 | 0 | 0.0 |
| 2 | 242 | 237 | 49.0 | 49 | 0 | 49 | 0.0 |
| 3 | 484 | 474 | 98.0 | 98 | 1 | 48 | −0.1 |
| 4 | 726 | 711 | 147.0 | 147 | 2 | 47 | −0.1 |
| 5 | 968 | 948 | 196.0 | 196 | 3 | 46 | −0.2 |
| 6 | 1210 | 1185 | 244.9 | 245 | 4 | 45 | −0.2 |
| 7 | 1451 | 1422 | 293.9 | 294 | 5 | 44 | −0.3 |
| 8 | 1693 | 1659 | 342.9 | 343 | 6 | 43 | −0.3 |
| 9 | 1935 | 1896 | 391.9 | 392 | 7 | 42 | −0.4 |
| 10 | 2177 | 2133 | 440.9 | 441 | 8 | 41 | −0.4 |
| 11 | 2419 | 2370 | 489.9 | 490 | 9 | 40 | −0.5 |
| 12 | 2661 | 2607 | 538.9 | 539 | 10 | 39 | −0.5 |
| 13 | 2903 | 2844 | 587.9 | 588 | 11 | 38 | −0.6 |
| 14 | 3145 | 3081 | 636.9 | 637 | 12 | 37 | −0.6 |
| 15 | 3387 | 3318 | 685.9 | 686 | 13 | 36 | −0.7 |
| 16 | 3629 | 3555 | 734.8 | 735 | 14 | 35 | −0.7 |
| 17 | 3870 | 3792 | 783.8 | 784 | 15 | 34 | −0.8 |
| 18 | 4112 | 4029 | 832.8 | 833 | 16 | 33 | −0.8 |
| 19 | 4354 | 4266 | 881.8 | 882 | 17 | 32 | −0.9 |
| 20 | 4596 | 4503 | 930.8 | 931 | 18 | 31 | −0.9 |
| 21 | 4838 | 4740 | 979.8 | 980 | 19 | 30 | −1.0 |
| 22 | 5080 | 4977 | 1028.8 | 1029 | 20 | 29 | −1.0 |
| 23 | 5322 | 5214 | 1077.8 | 1078 | 21 | 28 | −1.1 |
| 24 | 5564 | 5451 | 1126.8 | 1127 | 22 | 27 | −1.1 |
| 25 | 5806 | 5688 | 1175.8 | 1176 | 23 | 26 | −1.2 |
| 26 | 6048 | 5925 | 1224.7 | 1225 | 24 | 25 | −1.2 |
| 27 | 6290 | 6162 | 1273.7 | 1274 | 25 | 24 | −1.3 |
| 28 | 6531 | 6399 | 1322.7 | 1323 | 26 | 23 | −1.3 |
| 29 | 6773 | 6636 | 1371.7 | 1372 | 27 | 22 | −1.4 |
| 30 | 7015 | 6874 | 1420.7 | 1421 | 28 | 21 | −1.4 |
| 31 | 7257 | 7111 | 1469.7 | 1470 | 29 | 20 | −1.5 |
| 32 | 7499 | 7348 | 1518.7 | 1519 | 30 | 19 | −1.5 |
| 33 | 7741 | 7585 | 1567.7 | 1568 | 31 | 18 | −1.6 |
| 34 | 7983 | 7822 | 1616.7 | 1617 | 32 | 17 | −1.6 |
| 35 | 8225 | 8059 | 1665.7 | 1666 | 33 | 16 | −1.7 |
| 36 | 8467 | 8296 | 1714.6 | 1715 | 34 | 15 | −1.7 |

TABLE 4-continued

| | NOZZLE POSITION | | LOCATION IN Y DIRECTION | | | | |
|---|---|---|---|---|---|---|---|
| NOZZLE No. Nn | X DIRECTION (μm) | Y DIRECTION (μm) | SUB-PIXEL REAL NUMBER (dot) | SUB-PIXEL INTEGER NUMBER Nsi (dot) | PIXEL No. Np | SUB-PIXEL No. IN PIXEL Ns | POSITIONAL ERROR IN Y DIRECTION (μm) |
| 37 | 8709 | 8533 | 1763.6 | 1764 | 35 | 14 | −1.8 |
| 38 | 8950 | 8770 | 1812.6 | 1813 | 36 | 13 | −1.8 |
| 39 | 9192 | 9007 | 1861.6 | 1862 | 37 | 12 | −1.9 |
| 40 | 9434 | 9244 | 1910.6 | 1911 | 38 | 11 | −1.9 |
| 41 | 9676 | 9481 | 1959.6 | 1960 | 39 | 10 | −2.0 |
| 42 | 9918 | 9718 | 2008.6 | 2009 | 40 | 9 | −2.0 |
| 43 | 10160 | 9955 | 2057.6 | 2058 | 41 | 8 | −2.1 |
| 44 | 10402 | 10192 | 2106.6 | 2107 | 42 | 7 | −2.1 |
| 45 | 10644 | 10429 | 2155.6 | 2156 | 43 | 6 | −2.2 |
| 46 | 10886 | 10666 | 2204.5 | 2205 | 44 | 5 | −2.2 |
| 47 | 11128 | 10903 | 2253.5 | 2254 | 45 | 4 | −2.3 |
| 48 | 11370 | 11140 | 2302.5 | 2303 | 46 | 3 | −2.3 |
| 49 | 11611 | 11377 | 2351.5 | 2352 | 47 | 2 | −2.4 |
| 50 | 11853 | 11614 | 2400.5 | 2400 | 48 | 0 | 2.4 |
| 51 | 12095 | 11851 | 2449.5 | 2449 | 48 | 49 | 2.4 |
| 52 | 12337 | 12088 | 2498.5 | 2498 | 49 | 48 | 2.3 |
| 53 | 12579 | 12325 | 2547.5 | 2547 | 50 | 47 | 2.3 |
| 54 | 12821 | 12562 | 2596.5 | 2596 | 51 | 46 | 2.2 |
| 55 | 13063 | 12799 | 2645.4 | 2645 | 52 | 45 | 2.2 |
| 56 | 13305 | 13036 | 2694.4 | 2694 | 53 | 44 | 2.1 |
| 57 | 13547 | 13273 | 2743.4 | 2743 | 54 | 43 | 2.1 |
| 58 | 13789 | 13510 | 2792.4 | 2792 | 55 | 42 | 2.0 |
| 59 | 14030 | 13747 | 2841.4 | 2841 | 56 | 41 | 2.0 |
| 60 | 14272 | 13984 | 2890.4 | 2890 | 57 | 40 | 1.9 |
| 61 | 14514 | 14221 | 2939.4 | 2939 | 58 | 39 | 1.9 |
| 62 | 14756 | 14458 | 2988.4 | 2988 | 59 | 38 | 1.8 |
| 63 | 14998 | 14695 | 3037.4 | 3037 | 60 | 37 | 1.8 |
| 64 | 15240 | 14932 | 3086.4 | 3086 | 61 | 36 | 1.7 |
| | | | | | | MAXIMUM | 2.4 |
| | | | | | | MINIMUM | −2.4 |
| 65 | 15482 | 15169 | 3135.3 | 3135 | 62 | 35 | 1.7 |
| 66 | 15724 | 15406 | 3184.3 | 3184 | 63 | 34 | 1.6 |
| 67 | 15966 | 15643 | 3233.3 | 3233 | 64 | 33 | 1.6 |
| 68 | 16208 | 15880 | 3282.3 | 3282 | 65 | 32 | 1.5 |
| 69 | 16450 | 16117 | 3331.3 | 3331 | 66 | 31 | 1.5 |
| 70 | 16691 | 16354 | 3380.3 | 3380 | 67 | 30 | 1.4 |
| 71 | 16933 | 16591 | 3429.3 | 3429 | 68 | 29 | 1.4 |
| 72 | 17175 | 16828 | 3478.3 | 3478 | 69 | 28 | 1.3 |
| 73 | 17417 | 17065 | 3527.3 | 3527 | 70 | 27 | 1.3 |
| 74 | 17659 | 17302 | 3576.3 | 3576 | 71 | 26 | 1.2 |
| 75 | 17901 | 17539 | 3625.2 | 3625 | 72 | 25 | 1.2 |
| 76 | 18143 | 17776 | 3674.2 | 3674 | 73 | 24 | 1.1 |
| 77 | 18385 | 18013 | 3723.2 | 3723 | 74 | 23 | 1.1 |
| 78 | 18627 | 18250 | 3772.2 | 3772 | 75 | 22 | 1.0 |
| 79 | 18869 | 18487 | 3821.2 | 3821 | 76 | 21 | 1.0 |
| 80 | 19110 | 18724 | 3870.2 | 3870 | 77 | 20 | 0.9 |
| 81 | 19352 | 18961 | 3919.2 | 3919 | 78 | 19 | 0.9 |
| 82 | 19594 | 19198 | 3968.2 | 3968 | 79 | 18 | 0.8 |
| 83 | 19836 | 19435 | 4017.2 | 4017 | 80 | 17 | 0.8 |
| 84 | 20078 | 19672 | 4066.2 | 4066 | 81 | 16 | 0.7 |
| 85 | 20320 | 19909 | 4115.1 | 4115 | 82 | 15 | 0.7 |
| 86 | 20562 | 20146 | 4164.1 | 4164 | 83 | 14 | 0.6 |
| 87 | 20804 | 20383 | 4213.1 | 4213 | 84 | 13 | 0.6 |
| 88 | 21046 | 20621 | 4262.1 | 4262 | 85 | 12 | 0.5 |
| 89 | 21288 | 20858 | 4311.1 | 4311 | 86 | 11 | 0.5 |
| 90 | 21530 | 21095 | 4360.1 | 4360 | 87 | 10 | 0.4 |
| 91 | 21771 | 21332 | 4409.1 | 4409 | 88 | 9 | 0.4 |
| 92 | 22013 | 21569 | 4458.1 | 4458 | 89 | 8 | 0.3 |
| 93 | 22255 | 21806 | 4507.1 | 4507 | 90 | 7 | 0.3 |
| 94 | 22497 | 22043 | 4556.1 | 4556 | 91 | 6 | 0.2 |
| 95 | 22739 | 22280 | 4605.0 | 4605 | 92 | 5 | 0.2 |
| 96 | 22981 | 22517 | 4654.0 | 4654 | 93 | 4 | 0.1 |
| 97 | 23223 | 22754 | 4703.0 | 4703 | 94 | 3 | 0.1 |
| 98 | 23465 | 22991 | 4752.0 | 4752 | 95 | 2 | 0.0 |
| 99 | 23707 | 23228 | 4801.0 | 4801 | 96 | 1 | 0.0 |
| 100 | 23949 | 23465 | 4850.0 | 4850 | 96 | 0 | 0.0 |
| 101 | 24190 | 23702 | 4899.0 | 4899 | 97 | 49 | −0.1 |
| 102 | 24432 | 23939 | 4948.0 | 4948 | 98 | 48 | −0.1 |
| 103 | 24674 | 24176 | 4997.0 | 4997 | 99 | 47 | −0.2 |
| 104 | 24916 | 24413 | 5045.9 | 5046 | 100 | 46 | −0.2 |

TABLE 4-continued

| | NOZZLE POSITION | | LOCATION IN Y DIRECTION | | | | |
|---|---|---|---|---|---|---|---|
| NOZZLE No. Nn | X DIRECTION (μm) | Y DIRECTION (μm) | SUB-PIXEL REAL NUMBER (dot) | SUB-PIXEL INTEGER NUMBER Nsi (dot) | PIXEL No. Np | SUB-PIXEL No. IN PIXEL Ns | POSITIONAL ERROR IN Y DIRECTION (μm) |
| 105 | 25158 | 24650 | 5094.9 | 5095 | 101 | 45 | −0.3 |
| 106 | 25400 | 24887 | 5143.9 | 5144 | 102 | 44 | −0.3 |
| 107 | 25642 | 25124 | 5192.9 | 5193 | 103 | 43 | −0.4 |
| 108 | 25884 | 25361 | 5241.9 | 5242 | 104 | 42 | −0.4 |
| 109 | 26126 | 25598 | 5290.9 | 5291 | 105 | 41 | −0.5 |
| 110 | 26368 | 25835 | 5339.9 | 5340 | 106 | 40 | −0.5 |
| 111 | 26610 | 26072 | 5388.9 | 5389 | 107 | 39 | −0.6 |
| 112 | 26851 | 26309 | 5437.9 | 5438 | 108 | 38 | −0.6 |
| 113 | 27093 | 26546 | 5486.9 | 5487 | 109 | 37 | −0.7 |
| 114 | 27335 | 26783 | 5535.8 | 5536 | 110 | 36 | −0.7 |
| 115 | 27577 | 27020 | 5584.8 | 5585 | 111 | 35 | −0.8 |
| 116 | 27819 | 27257 | 5633.8 | 5634 | 112 | 34 | −0.8 |
| 117 | 28061 | 27494 | 5682.8 | 5683 | 113 | 33 | −0.9 |
| 118 | 28303 | 27731 | 5731.8 | 5732 | 114 | 32 | −0.9 |
| 119 | 28545 | 27968 | 5780.8 | 5781 | 115 | 31 | −1.0 |
| 120 | 28787 | 28205 | 5829.8 | 5830 | 116 | 30 | −1.0 |
| 121 | 29029 | 28442 | 5878.8 | 5879 | 117 | 29 | −1.1 |
| 122 | 29270 | 28679 | 5927.8 | 5928 | 118 | 28 | −1.1 |
| 123 | 29512 | 28916 | 5976.8 | 5977 | 119 | 27 | −1.2 |
| 124 | 29754 | 29153 | 6025.7 | 6026 | 120 | 26 | −1.2 |
| 125 | 29996 | 29390 | 6074.7 | 6075 | 121 | 25 | −1.3 |
| 126 | 30238 | 29627 | 6123.7 | 6124 | 122 | 24 | −1.3 |
| 127 | 30480 | 29864 | 6172.7 | 6173 | 123 | 23 | −1.4 |
| 128 | 30722 | 30101 | 6221.7 | 6222 | 124 | 22 | −1.4 |
| | | | | | | MAXIMUM | 1.7 |
| | | | | | | MINIMUM | −1.4 |

The mass of an actually ejected ink droplet differs by 10% to 20% among the nozzles 300. In order to overcome this problem, there have conventionally been provided analog-driving-signal generation devices each for corresponding one of the nozzles 300, so that each nozzle 300 is applied with an analog driving signal 406 specifically prepared for the nozzle 300 to have appropriate voltage, pulse width, and the like. This method is called all-amount trimming. However, it is not practical to provide so many number of analog-driving-signal generation devices for large number of nozzles 300. In order to overcome these problems, the present invention provides a high-speed ejection device capable of all-amount trimming without needing a large number of analog-driving-signal devices for all nozzles 300. Description of the ejection device according to the present embodiment will be described while referring to a specific example.

Here, it should be noted that components similar to those of the first embodiment will be assigned with the same numberings and description thereof will be omitted.

In the Tables 3 and 4, it is assumed that the resolution information 151 indicates a designated resolution of 105 dip as in the first embodiment. In this case also, the positional error with respect to the direction y decreases as the pixel-dividing number Nsp increases. In addition, as the pixel-dividing number Nsp increases, the number of the nozzles 300 having the same sub-pixel number Ns decreases. Here, the total 128-number of nozzles 300 are divided into four groups, i.e., a first group including the nozzles Nn=1 through 32, a second group including the nozzles Nn=33 through 64, a third group including the nozzles Nn=65 through 96, and a fourth group including the nozzles Nn=97 through 128. Each block corresponds to one of the four piezoelectric-element drivers 402, and the nozzles 300 in the same block share the same analog driving signal 406.

When the pixel-dividing number Nsp is increased to 50 or more, then no sub-pixel number Ns appears twice or more in the same group. Then the 32-number of nozzles 300 in each group become in one-to-one correspondence with the sub-pixel number Ns, so that only one of the 32-number of nozzles 300 performs ink ejection at one time. In other words, there is no nozzle 300 that performs the ink ejection as the same time of when other nozzle 300 in the same group performs the ink ejection. Accordingly the analog driving signal 406 drives only a single nozzle 300 in the corresponding group at one time. Therefore, by trimming the analog driving signal 406 in accordance with a subject nozzle 300 each time, the all-amount trimming is possible without providing a large number of analog-driving-signal generating devices for all of the nozzles 300.

In the present embodiment, it is necessary to prepare a driving waveform W(i) for each nozzle Nn=i before starting actual recording so that all the 128-number of nozzles 300 can eject ink droplets having the same mass. The mass of the ink droplets can be increased by changing the trapezoid waveform in a well-known manner, such as by increasing the voltage, changing a pulse width close to resonance requirement, shortening a rising time, or the like. Thus obtained driving waveforms are 10-bit quantized at 250 ns and then stored in the data processing device 103 in the following manner.

Because the pixel-dividing number Nsp=50 in the present example, then as shown in FIG. 10, the latch clock L-CLK is generated 50 times each time the pixel-synchronization signal 109 is generated once. As in the first embodiment, the first trapezoid waveform is generated when the orifice center of the nozzle Nn=1 is on the center of the sub-pixel Ns=0. At this time, the orifice center of other nozzles are located on sub-pixels indicated by the sub-pixel number Ns in the Table T4. The nozzles that have a chance to eject an ink droplet at this time are only nozzles 300 whose orifice center is located on the sub-pixel Ns=0, which is, in this case, the orifice whose sub-pixel number Ns=0 in the Table 4, i.e., the nozzle Nn=1 in the first group, the nozzle Nn=50 in the second group, no nozzle in the third group, and the nozzle Nn=100 in the fourth group. Accordingly, the waveforms W(i) are prepared and stored in the data processing device 103 so that the first trapezoid waveform for the first group becomes the waveform W(1) for the nozzle Nn=1, that the first trapezoid waveform for the second group becomes the waveform W(50) for the nozzle Nn=50, and that the first trapezoid waveform for the fourth group becomes the waveform W(100) for the nozzle Nn=100. No waveform is necessary for the third group.

The second trapezoid waveform is generated when the orifice center of the nozzle Nn=1 reaches the center of the sub-pixel Ns=1. The orifice center of the other nozzles 300 is located on the sub-pixel of its Ns+1. The nozzles 300 that have a chance for ink ejection at this time are only those whose orifice center is located on the sub-pixel Ns=0 at this time, which is, in this case, the orifice whose sub-pixel number Ns=49 in the Table 4, i.e., only the nozzle Nn=2 in the first group, the nozzle Nn=51 in the second group, no nozzle in the third group, and the nozzle Nn=101 in the fourth group. Accordingly, the waveforms W(i) are prepared and stored in the data processing device 103 so that the second trapezoid waveform for the first group becomes the waveform W(2) for the nozzle Nn=2, that the second trapezoid waveform for the second group becomes the waveform W(51) for the nozzle Nn=51, and that the second trapezoid waveform for the fourth group becomes the waveform W(101) for the nozzle Nn=101. No waveform is necessary for the third group. In this manner, the waveforms for all the nozzles are prepared for the 50 trapezoid waveforms and stored in the data processing device 103 for each block.

Next, the waveforms W are stored in the analog-driving-signal generation unit 110. As shown in FIG. 11, the analog-driving-signal generation unit 110 includes 10-bit line memories (FIFO) 901, digital-analog (D/A) converters 902, and transistor circuits 903, and the waveforms W are stored in the corresponding 10-bit line memories (FIFO) 901-1 to 901-4. Here, the line memories 901 are controlled by a write reset WR, a write clock WC, and a write data WD. That is, after the write reset WR clears an internal write address counter to 0, the 10 bit write data WD is stored in synchronization with the write clock WC. Eight words consist one chip. If a sampling time is 250 ns, then the waveforms W for 4 ms can be stored.

On the other hand, the line memories 901-1 to 901-4 are controlled by a read reset RR, a read clock RC, and a read data RD when reading. An internal read address counter is reset to 0 when the pixel-synchronization signal 109 is generated. Thereafter, the 10-bit read data RD is read out in synchronization with the read clock RC, which is a 4 MHz high-frequency clock. The read-out 10-bit waveforms W are converted into an analog signal by the D/A converter 902 and amplified by the transistor circuit 903 into the analog driving signal 406-1 to 406-4.

Figure 12:
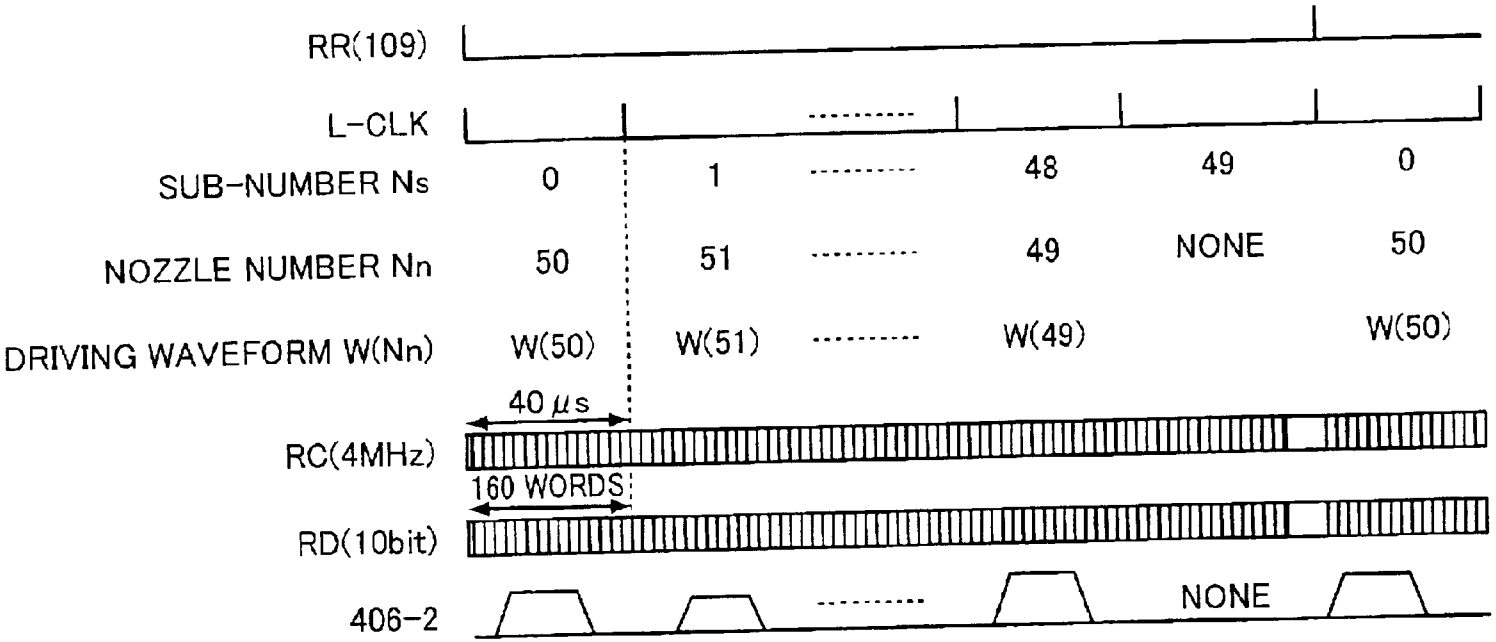
FIG. 12 is a timing chart of the analog-driving-signal generation unit of FIG. 11.

FIG. 12 shows a timing chart of the analog-driving-signal generation unit 110 according to the present embodiment. Explanation will be provided for generation processes of the analog driving signal 406-2 for the nozzles Nn=33 to 63 in the second block. The pixel-synchronization signal 109 from the timing controller 106 is used as the read reset RR. when the orifice center of the nozzle Nn=1 is on the original, i.e., on the center of the sub-pixel Ns=0, the first trapezoid waveform of the analog driving signal 406-2 generated at this time is the waveform W(50) corresponding to the nozzle Nn=50. Therefore, the waveform W(50) is read as a digital data (10-bit read data RD) for the waveform W (50) in synchronization with the read clock RC (4 MHz) from the timing controller 106, and is converted into the analog driving signal 406-2 through the D/A converter 902 and the transistor circuit 903. After 40 $\mu$s (160-word) worth of data is read, the orifice center of the nozzle Nn=1 reaches the center of the sup-pixel Ns=1, and the second trapezoid waveform of the analog driving signal 406-2 is generated. The second trapezoid waveform of the analog driving signal 406-2 is the waveform W(51) for the nozzle Nn=51 as described above. When the analog driving signals 406-2 for all the 50 sub-pixels (2 ms worth of signals) are generated in this manner, then the process waits until the next read reset RR is generated. Here, because the pixel-dividing number Nsp=50 is the minimum number that satisfies the above requirement (one-to-one correspondence between the nozzles and the Ns in each group), a maximum recording speed is achieved.

As described above, according to the present embodiment, it is possible to drive each nozzle 300 using a driving waveform appropriate for the nozzle 300, realizing all-amount trimming. This enables the nozzles 300 to eject ink droplets having the same mass, providing a high-quality image.

Here, generating four analog driving signals 406-1 to 406-4 using a single analog-driving-signal generation unit 110 as in the above embodiment makes the configuration of the analog-driving-signal generation unit 110 rather complex and also increases the manufacturing costs of the analog-driving-signal generation unit 110. Accordingly, it is conceivable to generate a less number of analog driving signals 406. For example, only a single analog driving signal 406 could be used instead of four analog driving signals 406-1 to 406-4 as in the first embodiment. However, in this case, the pixel-dividing number Nsp must be increased with a resultant decrease in recording speed (sheet-feed speed vp).

Next, a third embodiment of the present invention will be described. Here, the components similar to that of the above-described embodiments will be assigned with the same numberings, and their explanation will be omitted.

Figure 13:
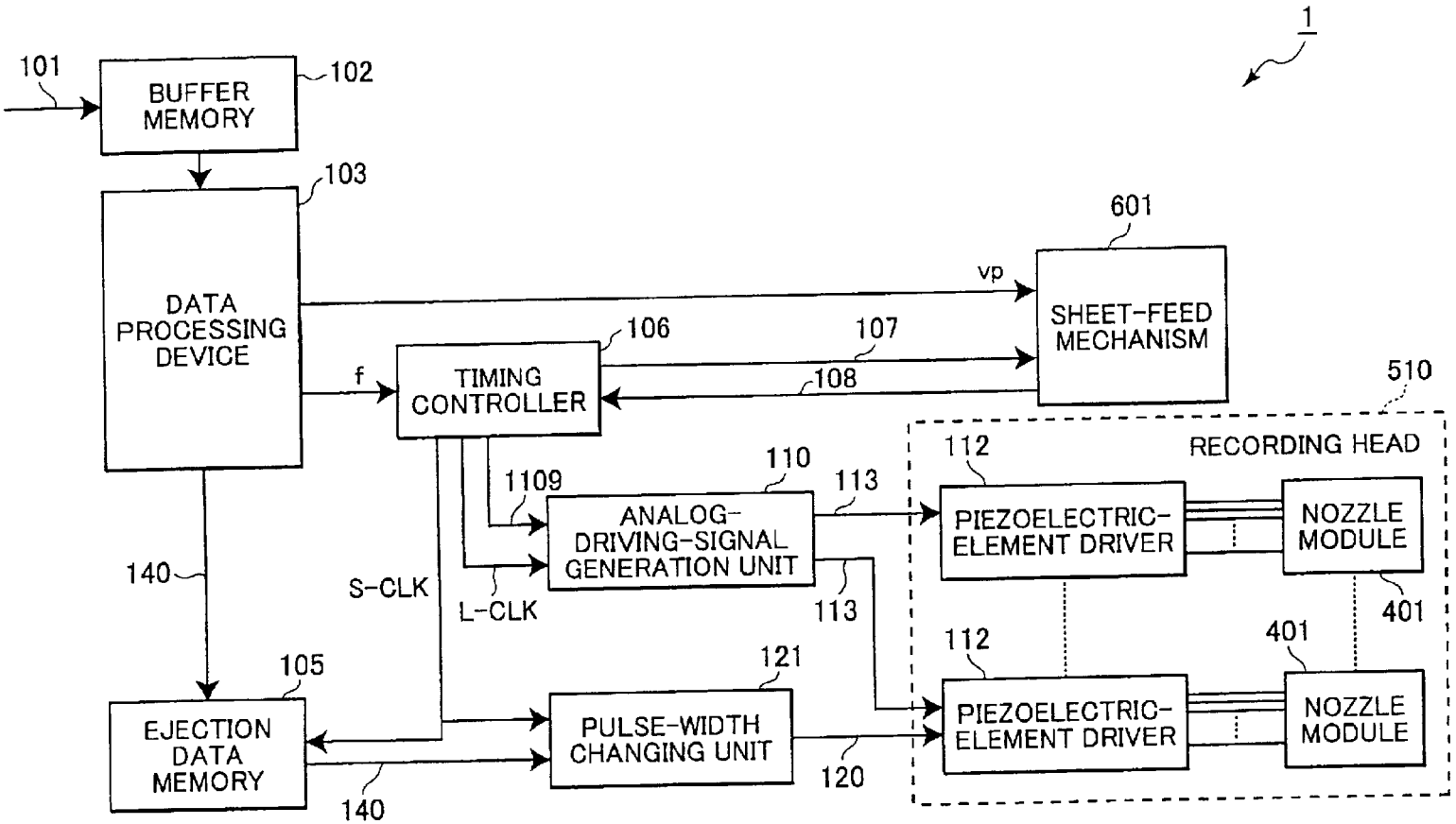
FIG. 13 shows an overall configuration of an inkjet recording device according to a third embodiment of the present invention.

An inkjet recording device 2 according to the present embodiment shown in FIG. 13 has a similar configuration as that of the inkjet recording device 1 of the first embodiment. However, the inkjet recording device 2 includes a pulse-width changing unit 121 and a recording head 510 instead of the digital-ejection-signal generation unit 111 and the recording head 501. The recording head 510 includes a plurality of nozzle modules 401 and a plurality of piezoelectric-element drivers 112. Although not shown in the drawings, the pulse-width changing unit 121 includes a plurality of pulse-width changing members each for corresponding one of the nozzle modules 401.

Figure 14:
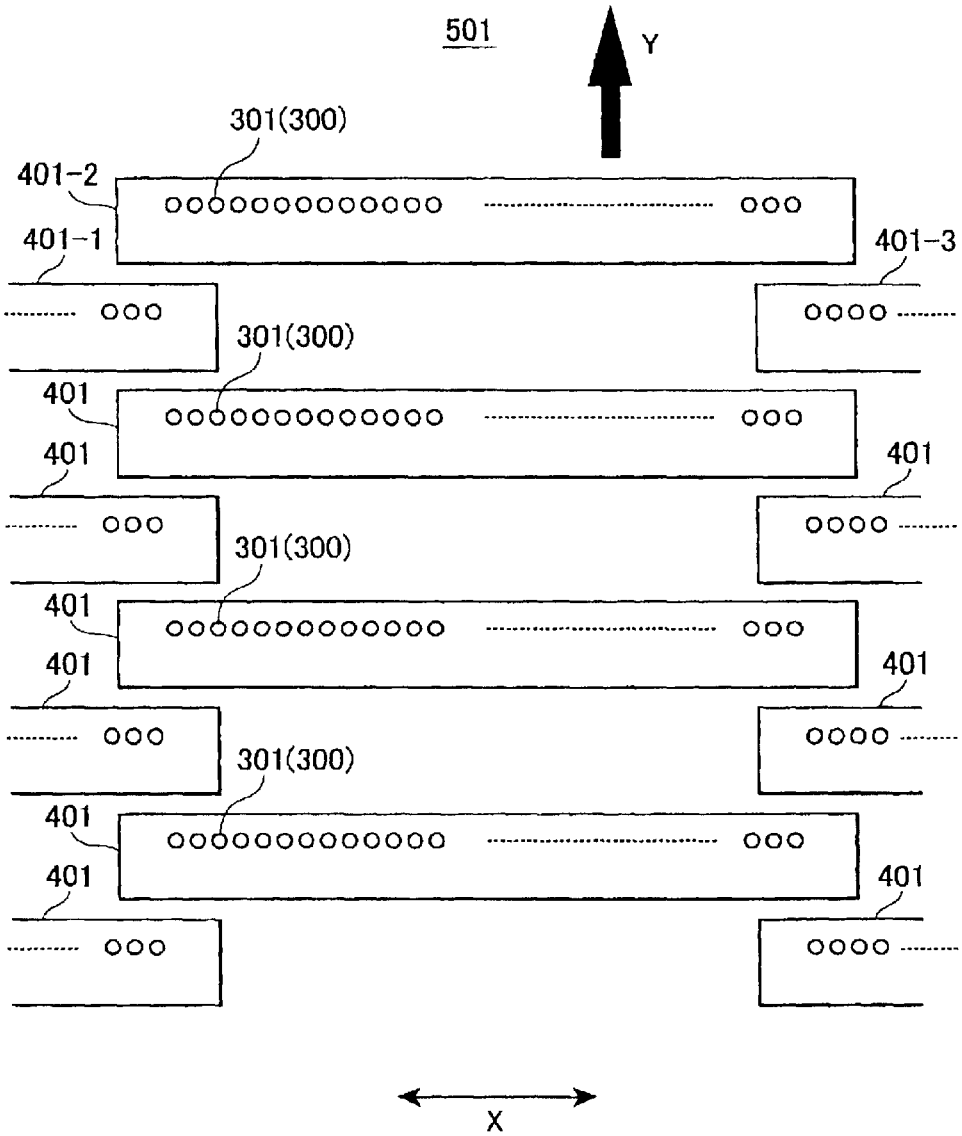
FIG. 14 is an explanatory plan view of nozzle modules arranged in eight rows.

As shown in FIG. 14, each nozzle module 401 is formed with 128-number of nozzles 300 aligned with equidistance from each other. Because the recording head 510 needs 2,550 number of nozzles 300 for forming 300 dpi monochromatic images on an A-4-sized recording sheet having a width of 8.5 inches, and over ten-thousand number of nozzles 300 for forming 300 dpi multi-color images using four colors of ink, the recording head 510 is usually formed of a plurality of nozzle modules as of recording head 510 of the present embodiment.

In FIG. 14, ink droplets are ejected from the nozzle modules 401 in a direction perpendicular to the sheet surface of FIG. 14. The nozzle pitch is 75 nozzles per inch (npi), and thus the 128-number of nozzles 300 define a nozzle line having a length of approximately 43 mm. As shown in FIG. 14, the nozzle modules 401 are arranged in eight lines in alternation. This configuration realizes the recording head 510 having a nozzle pitch of 300 npi with respect to a widthwise direction X, enabling to form 300 dpi images, although each nozzle module 401 has the nozzle pitch of 75 npi. Because the manufacturing technique of the recording head 510 is well known, the explanation thereof will be omitted.

Figure 15:
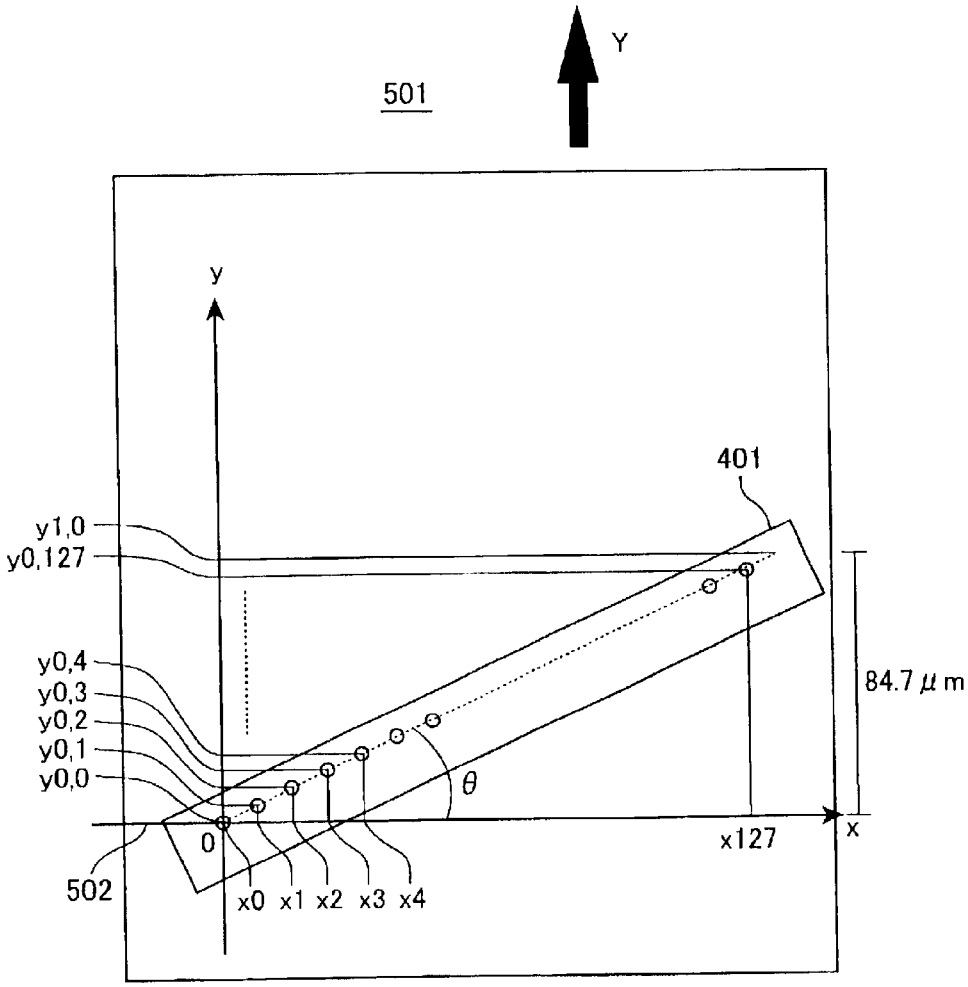
FIG. 15 is an explanatory view of one of the nozzles modules of FIG. 14.

Although each nozzle module 401 seems extending parallel to a widthwise direction X of the continuous recording sheet 602 which is perpendicular to the sheet feed direction Y in FIG. 14, the nozzle module 401 is actually disposed forming an angle θ with respect to the widthwise direction X as shown in FIG. 15. The angle θ is expressed in the following formula:

$$\tan\theta=1/128$$

wherein 128 is the number of the nozzles 300 formed in the nozzle module 401.

In the present embodiment, resolution of images with respect to the sheet feed direction Y is set to 300 dpi. Thus, each pixel has a width of 84.7 μm in the sheet feed direction Y, and a distance between adjacent two nozzles with respect to the sheet feed direction Y is 0.66 μm (84.7/128=0.66). In the present embodiment, the rotary encoder 605 of the sheet feed mechanism 601 shown in FIG. 13 is set to generate the sheet-position indication pulse 108 once each time the continuous recording sheet 602 is transported by 1/128-pixel worth of distance, i.e., 0.66 μm. Accordingly, the timing controller 106 generates a sub-pixel-synchronization signal 1109 in synchronization with the sheet-position indication pulse 108 once each time the continuous recording sheet 602 is transported by 1/128-pixel worth of distance. In other words, each pixel having the width of 84.7 μm in the sheet feed direction Y is divided into 128-number of sub-pixels each having a width of 0.66 μm in the sheet feed direction Y, and the sub-pixel-synchronization signal 1109 is generated once each time the continuous recording sheet 602 is transported by a single-sub-pixel worth of distance.

In FIG. 15, the 128-number of nozzles 300 are numbered starting from 0 to 127 from the left to the right. Here, in order to facilitate explanation, an x-y coordinate system is shown in FIG. 15, wherein the y axis extends in the sheet feed direction Y, and the x axis extends perpendicular to the sheet feed direction Y. A position of each nozzle 300 is expressed using a coordinate value (x, $y_m$), wherein x represents a location with respect to the x direction, and y represents a location with respect to the y direction, and m (m=0, 1, . . . 127) represents a location within a pixel with respect to the y direction.

Here, as described above, each pixel has the width of 84.7 μm in the direction Y, and each sub-pixel has a width of 84.7/128 μm (0.66 μm) in the direction Y. Accordingly, the following formulas are derived:

$$y_{m,0}-y_{m-1,0}=84.7$$

$$y_{m,n}-y_{m,n-1}=84.7/128$$

wherein m=1 . . . , 128, and n=1 . . . , 128.

In the present embodiment, an ejection position 502 fixed on the recording sheet 602 where each the nozzle 300 performs ink ejection is initially on a line y=0. Accordingly, in the status shown in FIG. 15, of the 128-number of nozzles 300, only the $1^{st}$ nozzle Nn=1 located at ($x_0$, $y_{0,0}$) has a chance for ink ejection. When the continuous recording sheet 602 is transported by a single-sub-pixel worth of distance, whereby the ejection position 502 reaches a line $y=y_{0,1}$, then only the $2^{nd}$ nozzle Nn=2 located at ($x_1$, $y_{0,1}$) has a chance for ink ejection. In the same manner, when the ejection position 502 reaches a line $y=y_{0,n-1}$, then only a $n^{th}$ nozzle Nn=n at ($x_{n-1}$, $y_{0,n-1}$) has a chance for ink ejection.

When the continuous recording sheet 602 is transported by one-sub-pixel worth of distance after the ejection position 502 has reached a line $y=y_{0,127}$ where only the nozzle Nn=128 at ($x_{127}$, $y_{0,127}$) has a chance for ink ejection, the ejection position 502 reaches a line $y=y_{1,0}$, so that only the nozzle Nn=1 has a chance for ink ejection. The ejection operation is preformed repeating the above process.

In FIG. 13, the data processing device 103 generates an ejection-tone data 140 instead of the ejection data 104 by processing the bitmap data 101 in a conventional method.

In this example, the ejection-tone data 140 is an 8-bit binary data (0 through 255 in decimal numeration). The ejection-tone data 140 having a value of "0" indicates an ejection amount of "0", and the ejection-tone data 140 having a value of "255" indicates a maximum ejection amount.

Figure 16A:
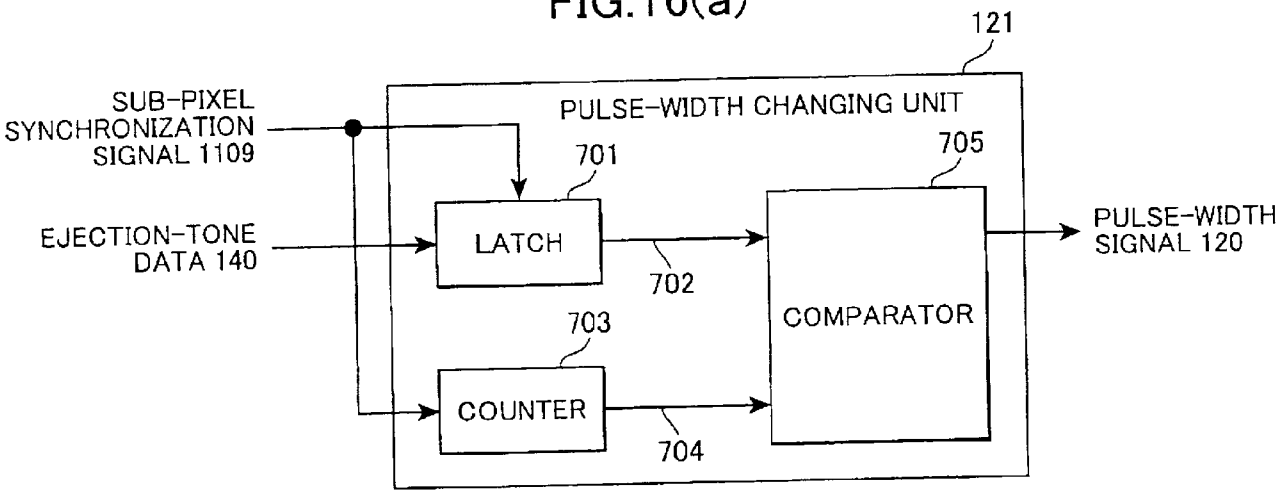
FIG. 16(*a*) is a block diagram showing components of a pulse-width adjusting unit.
Figure 16B:
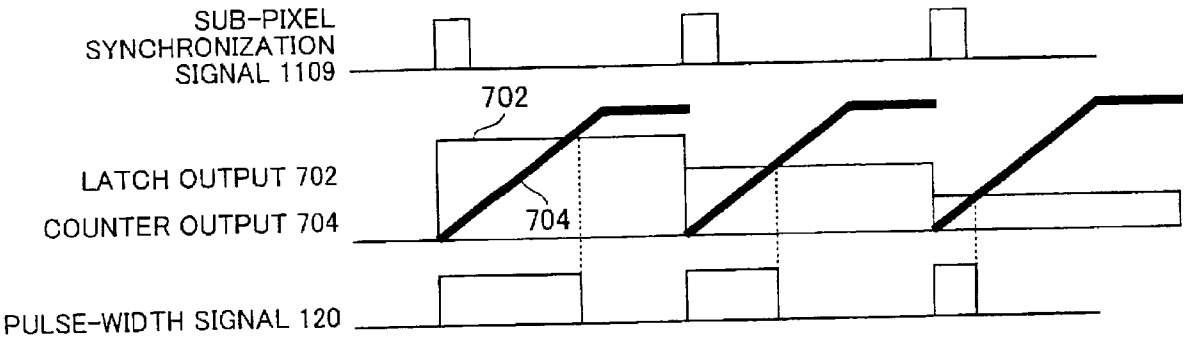

As shown in FIG. 16(*a*), the pulse-width changing unit 121 includes an 8-bit latch 701, an 8-bit counter 703, and an 8-bit magnitude comparator 705. The latch 701, the counter 703, the magnitude comparator 705 are all commercially available as a standard Transistor Transistor Logic (TTL) IC. The ejection-tone data 140 is input to the latch 701 in synchronization with the sub-pixel-synchronization signal 1109, and output from the latch 701 as a latch output 702.

An counter output 704 from the counter 703 is reset to 0 each time the sub-pixel-synchronization signal 1109 is generated, and increases until 255 and then levels off. The magnitude comparator 705 compares the latch output 702 and the counter output 704, and as shown in FIG. 16(*b*) outputs a pulse-width signal 120 of "1" when the latch output 702 is greater than the counter output 704 and outputs pulse-width signal 120 of "0" otherwise.

Accordingly, the pulse-width of the pulse-width signal 120 is in approximate proportion to the ejection-tone data 140. In this manner, the ejection-tone data 140 is converted into the pulse-width signal 120. By converting the ejection-tone data 140 which is the 8-bit binary data into the pulse width of the pulse-width signal 120 in this manner, it is possible to reduce the number of signal wirings and also to provide a high tolerance for noise.

Figure 17A:
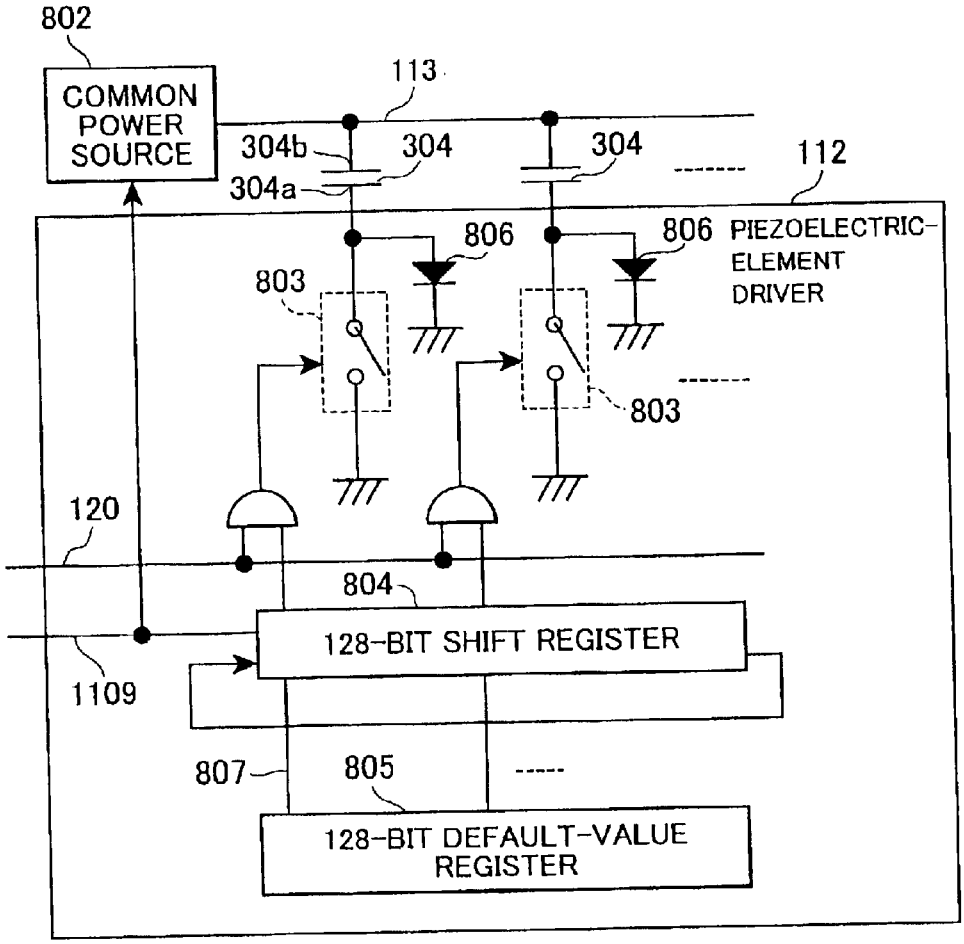
FIG. 17(*a*) shows a configuration of a piezoelectric-element driver according to the third embodiment.
Figure 17B:
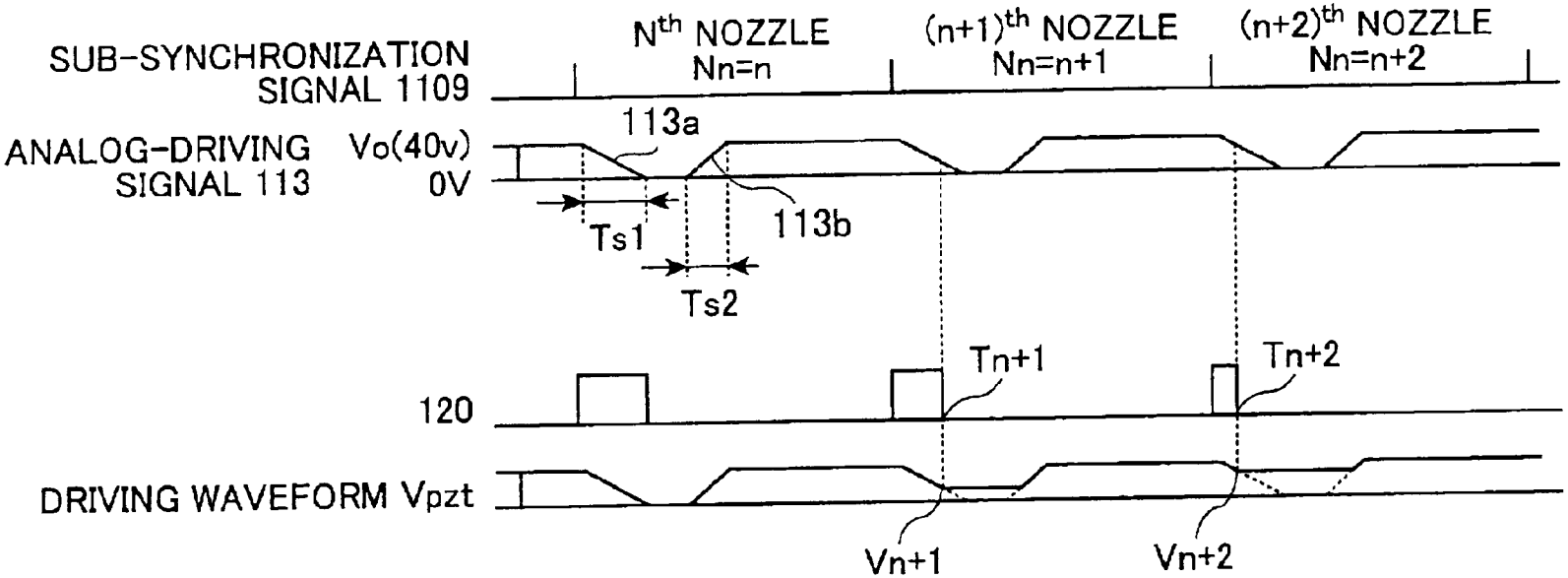

Next, the piezoelectric-element driver 112 according to the present embodiment will be described. As shown in FIG. 17(*a*), the piezoelectric-element driver 112 is connected to the 128-number of piezoelectric elements 304 of the corresponding nozzle module 401. A common driving power source 802 is capable of supplying power energy sufficient for driving the piezoelectric element 304 (10A for example), and applies an analog-driving signal 113 to a common terminal 304*b* of each piezoelectric element 304 in synchronization with the sub-pixel-synchronization signal 1109. The piezoelectric-element driver 112 includes 128-number of switches 803, 128-number of diodes 806, a 128-bit shift register 804, and a 128-bit default-value register 805. The default-value register 805 stores 128-bit default-value data 807 of "0, 0, 0, . . . , 0, 1", for example. Each bit of the default-value data 807 corresponds to one of the 128-number of nozzles 300 of the corresponding nozzle module 401. That is, the leftmost bit "0" corresponds to the $1^{st}$ nozzle Nn=1, and the rightmost bit "1" corresponds to the $128^{th}$ nozzle Nn=128.

When the printing operations are started, then shift register 804 retrieves the default-value data 807 from the default-value register 805 and then rotates the default-value data 807 one bit at a time in synchronization with the sub-pixel-synchronization signal 1109. More specifically, when the first sub-pixel-synchronization signal 1109 is received, then the default-value data 807 shifts rightward one bit at a time, and a rightmost bit is placed in the leftmost location, so that the default-value data 807 "0, 0, 0, . . . , 0, 1" becomes "1, 0, 0, . . . 0, 0". When the sub-pixel-synchronization signal 1109 is generated next time, then the default-value data 807 becomes "0, 1, 0, . . . , 0, 0". Here, the default-value data 807 having a value of "1" indicates "ejection", and the default-value data 807 having the value of "0" indicates "non-ejection". A logical product of the output from the shift register 804 and the pulse-width signal 120 is output to a switch terminal of each switch 803. The switch 803 connects an individual terminal 304*a* of the corresponding piezoelectric element 304 to the ground when the value "1" is applied to the switch terminal, and the switch 803 opens the individual terminal 304*a* of the piezoelectric element 304 when the value "0" is applied to the switching terminal.

Next, an operation of the piezoelectric-element driver 112 will be described with reference to FIG. 17(*b*) First, when the sub-pixel-synchronization signal 1109 is generated, then the default-value data 807, which has been stored in the shift register 804 at the time of when the operation was started, rotates by one bit, so that the default-value data 807 "0, 0, 0, . . . , 0, 1" becomes "1, 0, 0, . . . , 0, 0", for example. Here, since the leftmost bit has the value of "1" indicating "ejection", then the only the $1^{st}$ nozzle Nn=1 has a change to eject an ink droplet. When the default-value data 807 becomes "0, 1, 0, . . . , 0, 0" by rotating by one more bit when a subsequent sub-pixel-synchronization signal 1109 is generated, then only the second bit from the left has the value of "1", so that only the $2^{nd}$ nozzle Nn=2 has a chance for ink ejection. In this manner, the $1^{st}$ through $128^{th}$ nozzles (Nn=1 through 128) have chance for ink ejection by turns. After the $128^{th}$ nozzle Nn=128, the $1^{st}$ nozzle Nn=1 has a chance.

In this embodiment, the power source 802 generates analog-driving signal 113 having a trapezoid waveform as shown in FIG. 17(*b*) in synchronization with the sub-pixel-synchronization signal 1109. The analog-driving signal 113 initially has a maximum voltage V0 of 40V, and drops to approximately 0V taking a time duration Ts1, defining a lamp waveform 113*a*. As a result, ink meniscus is drawn into the orifice 301. Then, after a predetermined time has elapsed, the voltage increases from 0V to the maximum 40V taking a time duration Ts2 shorter than the time duration Ts1, defining a lamp waveform 113*b*. The lamp waveform 113*b* defines an ejection waveform, so the lamp waveform 113*a* and 113*b* together define a driving waveform. A larger ink droplet is ejected at a higher ejection speed when the maximum voltage V0 is set larger and the time duration Ts2 is set shorter. The ejection speed tends to rely on the time duration Ts2 more, and the mass of the ink droplet tends to rely on the maximum voltage V0. Accordingly, when a user wishes to change the mass of the ink droplet without changing the ejection speed, then the maximum voltage V0 could be increased and the time duration Ts2 could be slightly elongated for increasing the mass, and the maximum voltage V0 could be decreased and the time duration Ts2 could be slightly shortened for decreasing the mass.

In the present embodiment, the maximum voltage V0 and the time duration Ts2 are automatically adjusted in accordance with the pulse-width signal 120 in the following manner.

When $n^{th}$ nozzle Nn=n has a chance for ink ejection in FIG. 17(*b*), the pulse-width signal 120 has a time width that is longer than the time duration Ts1. Accordingly, the individual terminal 304*a* of the piezoelectric element 304 is maintained at a ground voltage during when the lamp waveform 113*a* is output. Accordingly, a waveform Vpzt applied to the piezoelectric elements 304 becomes identical to the analog-driving signal 113. When the lamp waveform 113*b* is output, the individual terminal 304*a* of the piezoelectric elements 304 is maintained at the ground voltage due to the diodes 806. Accordingly, the waveform Vpzt becomes identical to the analog-driving signal 113.

When the (n+1) th nozzle Nn=n+1 has a chance for ink ejection, the pulse-width signal 120 has a time width slightly shorter than the time duration Ts1. Accordingly, the individual terminal 304*a* is maintained at the ground voltage level until the time Tn+1, so that the waveform Vpzt has a waveform identical to the analog-driving signal 113 until then. However, when the individual terminal 304*a* is opened at the time Tn+1, then the waveform Vpzt levels off and is maintained at a voltage Vn+1. This voltage of Vn+1 is maintained until the voltage of the analog-driving signal 113 increases to Vn+1 in the lamp waveform 113*b* since the individual terminal 304*a* is maintained opened until then. When the analog-driving signal 113 reaches Vn+1 in the lamp waveform 113*b*, then the diodes 806 connects the individual terminal 304*a* to the ground, so that the waveform Vpzt has a waveform identical to the analog-driving signal 113 thereafter.

When the $(n+2)^{th}$ nozzle Nn=n+2 has a chance for ink ejection, the pulse-width signal 120 has a time width much shorter than the time duration Ts1. Accordingly, the individual terminal 304*a* is maintained at the ground voltage level until the time Tn+2, so that the waveform Vpzt has a waveform identical to the analog-driving signal 113 until then. However, when the individual terminal 304*a* is opened at the time Tn+2, then the waveform Vpzt levels off and is maintained at a voltage Vn+2. This voltage of Vn+2 is maintained until the voltage of the analog-driving signal 113 increases to Vn+2 in the lamp waveform 113*b* since the individual terminal 304*a* is maintained opened until then. When the analog-driving signal 113 reaches Vn+2 in the lamp waveform 113*b*, then the diodes 806 connects the individual terminal 304*a* to the ground, so that the waveform Vpzt has a waveform identical to the analog-driving signal 113 thereafter.

Although not shown in the drawings, when the pulse-width signal 120 has a time width of 0, then the individual terminal 304*a* is maintained opened, so that the waveform Vpzt is maintained 0V.

As shown in FIG. 17(*b*), the waveform Vpzt for the $(n+1)^{th}$ nozzle Nn=n+1 has a rising time and a time width both shorter than that of the waveform Vpzt for the nth nozzle Nn=n. Accordingly, an ink droplet ejected from the $(n+1)^{th}$ nozzle Nn=n+1 is reduced in its mass. However, the ejection speed is maintained due to the shortened rising time. That is, a smaller ink droplet is ejected at the same speed from the $(n+1)^{th}$ nozzle Nn=n+1 in comparison with that from the nth nozzle Nn=n.

The waveform Vpzt for the $(n+2)^{th}$ nozzle Nn=n+2 has a further reduced time width. Here, when the time width of the waveform Vpzt is reduced smaller than a predetermined width, then the corresponding nozzle ejects no ink droplet. However, in this case also, the ink meniscus in the orifice 301 vibrates, preventing ejection failure due to condensed ink.

Figure 18A:
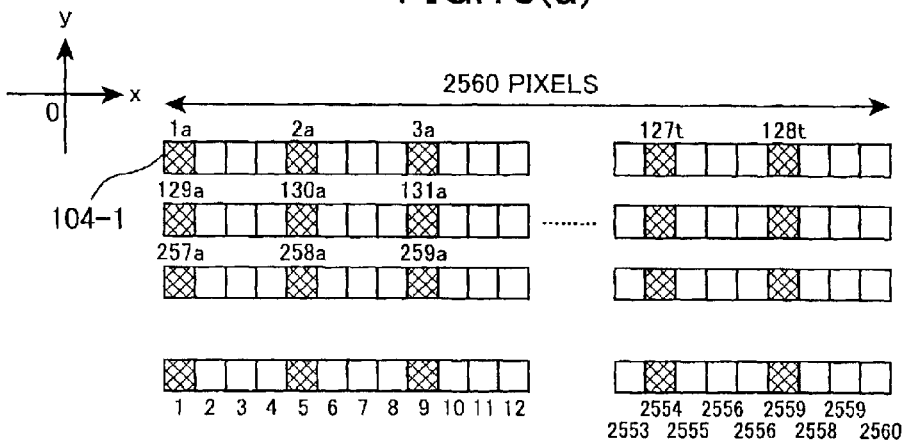
FIG. 18(*a*) shows ejection data in an original order.
Figure 18B:
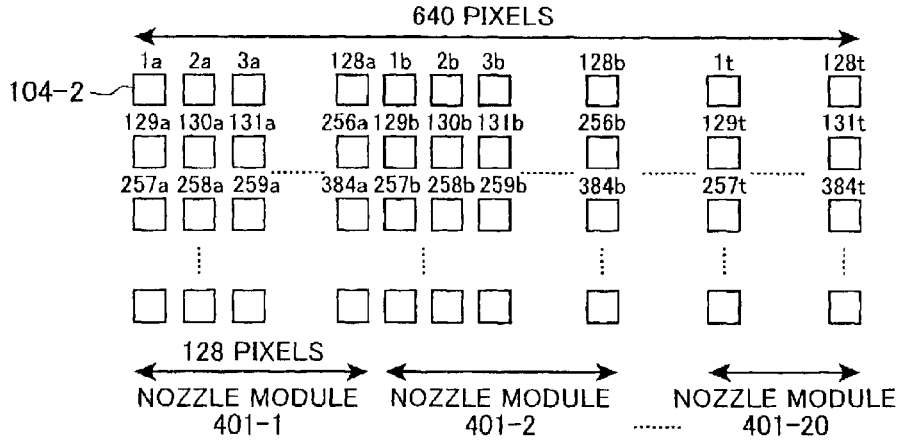
Figure 18C:
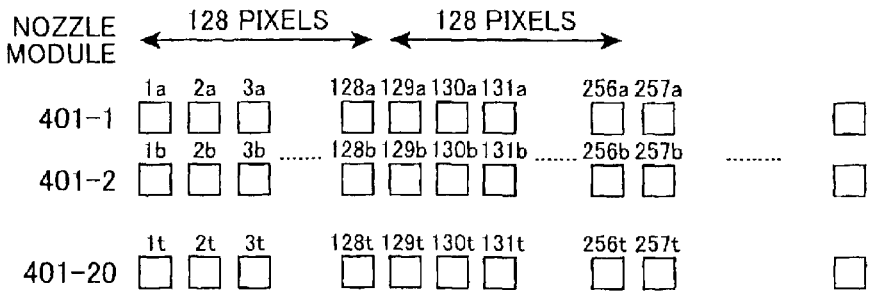

Next, a method of generating ejection-tone data 140 will be described. As described above, the ejection-tone data 140 is a 8-bit binary data generated for each 300 dpi pixel. FIG. 18(*a*) shows ejection-tone data 140-1 arranged in original order based on an original image. In the present embodiment, the recording head 510 is for forming a 300 dpi image on a medium with an A4-sized width of 210 mm, the image has 2,560 pixels in the x direction. It is possible to form such an image since the recording head 501 includes 20-number of nozzle modules 401 for each color arranged as shown in FIG. 14.

FIG. 18(*b*) shows ejection-tone data 140-2, generated by rearranging the ejection-tone data 140-1, for the nozzle modules defining the upper two of the eight rows shown in FIG. 14. Because the nozzle module 401 has the nozzle pitch of 75 npi that is one quarter of the resolution 300 dpi, one bit every four bits of the ejection-tone data 140-1 appearing in the x direction from the left, i.e., bits Nos. 1+(i×4) (1=0, 1, 2, . . . ), are extracted and arranged for generating the ejection-tone data 140-2 shown in FIG. 18(*b*) for the nozzle module 401-1 through 401-20.

Then, the ejection-tone data 140-2 is rearranged in a transfer order in which the bits of the ejection-tone data 140-2 are transferred to the piezoelectric-element driver 112 for each nozzle module 401, thereby generating the ejection-tone data 140 shown in FIG. 18(*c*), which the ejection memory 105 stores. In other words, as shown in FIG. 18(*c*), the ejection-tone data 140 is arranged in an ejection order (starting from the nozzle Nn=1 and ending at the nozzle Nn=128) for each nozzle module 401. When the operation is started, the ejection-tone data 140 is output one bit at a time to the pulse-width changing unit 121 in synchronization with the sub-pixel-synchronization signal 1109. This is why the pulse-width changing unit 121 needs to include the plurality of pulse-width adjusters each for corresponding one of the nozzle modules 401. Here, in FIGS. 18(*a*) through 18(*c*), each bit of the ejection-tone data 140 is assigned with numbered in order to facilitate explanation.

Figure 19:
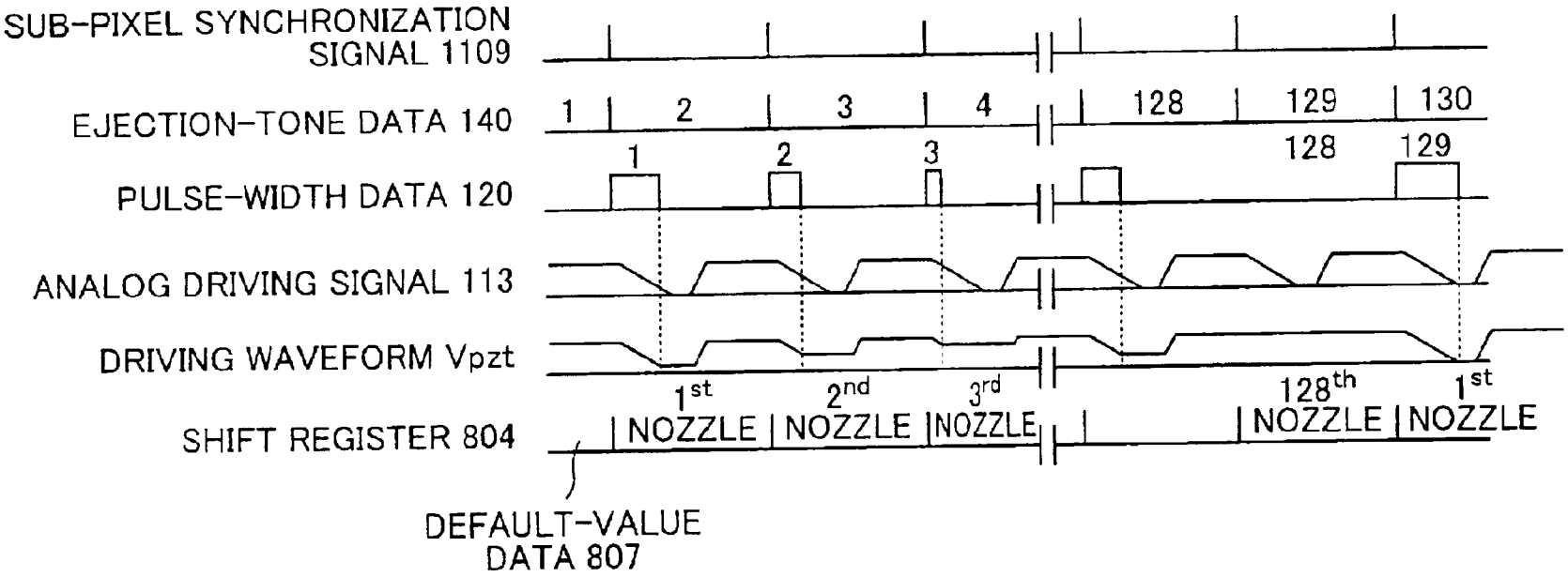
FIG. 19 is a timing chart relating to ejection data and an recording head.

FIG. 19 shows timing chart relating to the ejection-tone data 140 and the recording head 510.

As shown in FIG. 19, the ejection-tone data 140 is converted into the pulse-width signal 120 in synchronization with the sub-pixel-synchronization signal 1109. At the same time, the analog-driving signal 113 is applied to the piezoelectric element 304 at its common terminal 304*b* in synchronization with the sub-pixel-synchronization signal 1109. Further, the logical product of the output of the shift register 804 and the pulse-width signal 120 is applied to the switching terminal of the switch 803. The default-value data 807 that has been stored in the shift register 804 at the time of when the operation was first started is rotated by one bit in synchronization with the first sub-pixel-synchronization signal 1109 in the manner described above, so that only the $1^{st}$ nozzle Nn=1 has a chance for ink ejection. The pulse-width signal 120 output from the pulse-width changing unit 121 at this time is for the $1^{st}$ nozzle Nn=1, and the waveform Vpzt generated in accordance with the pulse-width signal 120 is selectively applied to the piezoelectric element 304 of only the first nozzle Nn=1, so that an ink droplet having a desired mass is ejected from the $1^{st}$ nozzle Nn=1.

It should be noted that it is possible to the change default-value data 807 before the operation starts in order to change a nozzle that has an ejection chance first. In this manner, locations of different colored images could be adjusted to form a singe multi-colored image, for example.

According to the present embodiment, the piezoelectric-element driver 112 can have a conventional configuration, so that the present invention is well suited for multi-nozzle inkjet recording devices. Also, converting the ejection-tone data 140 into the pulse-width signal 120 enables simple signal wirings and in addition provides a high tolerance for noise.

Figure 20:
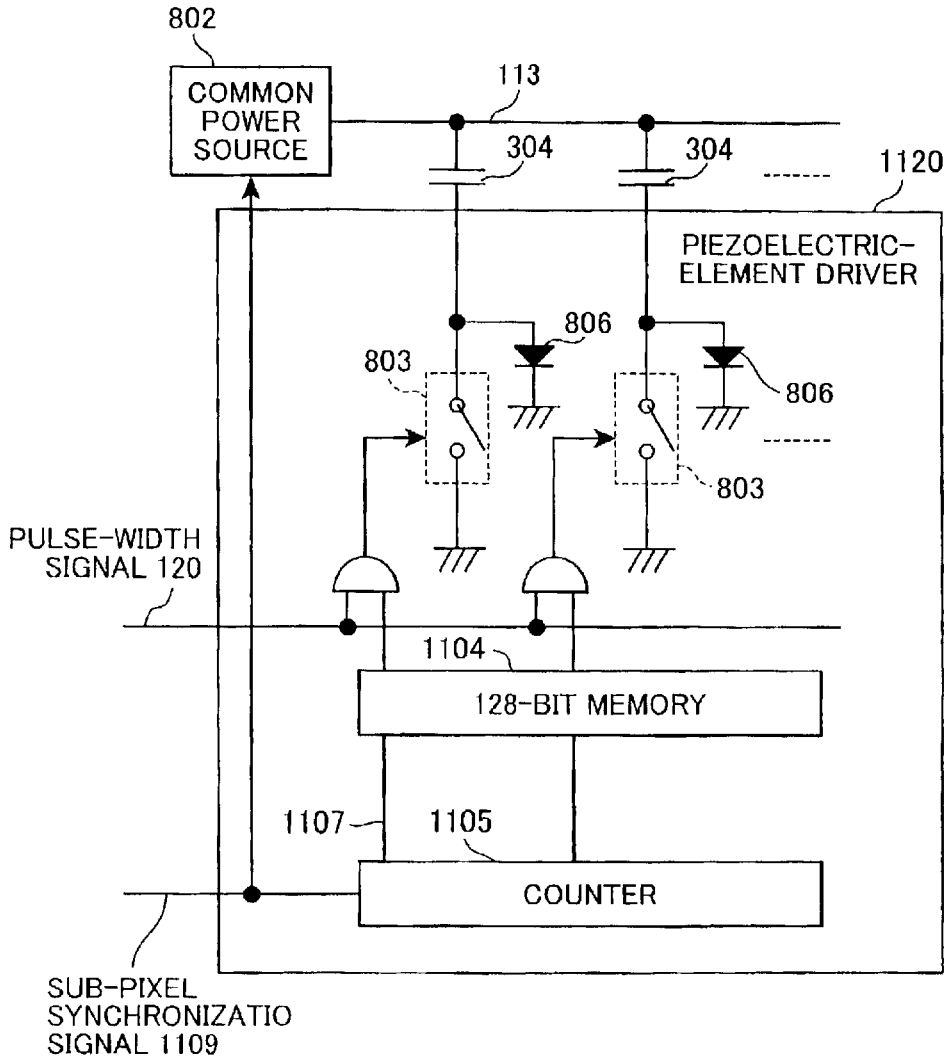
FIG. 20 shows a configuration of the piezoelectric-element driver according to a modification of the third embodiment of the present invention.

The above-described third embodiment could be modified as shown in FIG. 20 to use a piezoelectric-element driver 1120 instead of the piezoelectric-element driver 112. The piezoelectric-element driver 1120 includes a 120-bit memory 1104 and a counter 1105. The counter 1105 counts the sub-pixel-synchronization signal 1109, and a counter output 1107 from the counter 1105 serves as an address of the 120-bit memory 1104. In this configuration, the ejection order of the nozzles 300 can be controlled by changing contents of the 120-bit memory 1104. Accordingly, a recording operation can be performed properly even when the angle θ shown in FIG. 15 is changed or when the resolution in the sheet feed direction Y is changed.

In this manner, using the piezoelectric-element driver 1120 including the 120-bit memory 1104 and the counter 1105 rather than the conventional piezoelectric-element driver 112 provides a highly flexible system.

As described above, the inkjet recording device 2 according to the third embodiment can change the tone of each recording dot by multi tone levels any time required, providing high-quality images.

While some exemplary embodiments of this invention have been described in detail, those skilled in the art will recognize that there are many possible modifications and variations which may be made in these exemplary embodiments while yet retaining many of the novel features and advantages of the invention.

For example, the above embodiments described inkjet recording devices that perform image forming while continuously transporting a recording sheet with respect to a recording head that is held still. However, the present invention can be applied to inkjet recording devices wherein the image forming is performed by moving the recording head across the recording sheet in its longitudinal direction without moving the recording sheet, or to the devices wherein the recording head scans across the recording sheet in its widthwise direction. Further, the present invention can be applied to various types of ejection devices other than the inkjet recording devices.

Also, although the piezoelectric element is used in the above embodiments, other types of energy generating means, such a heat element, can be used.

The nozzle density and the number of the nozzles are mere examples of the present embodiments, so the present invention can be applied to devices including a head that has a different nozzle density and a different number of nozzles.

It is possible to provide more or less than four piezoelectric-element drivers. Although in the above second embodiment the 32-nozzle drivers control driving the corresponding 32-number of nozzles, it is possible that the 32-nozzle drivers control driving only corresponding 16-number of nozzles. For example, when 8-number of 32-nozzle drivers drive the 128-number of nozzles in total, then each nozzle driver is connected to 16-number of nozzles. In this case, the maximum pixel-dividing number Nsp can be determined taking the only 16-number of nozzles into consideration, so that Nsp could be reduced to half of the above-described second embodiment. If the Nsp decreases, the sheet-feed speed vp is increased.

What is claimed is:

1. An ejection device comprising:

a head formed with a plurality of nozzles arranged in a row for selectively ejecting droplets from the nozzles so as to form dots onto a medium;

a transporting means for transporting the medium relative to the head in a first direction;

a resolution specifying means for specifying a resolution with respect to the first direction;

a preciseness specifying means for specifying preciseness in dot locations on the medium;

an angle specifying means for specifying an angle of the head with respect to a second direction perpendicular to the first direction based on the specified resolution;

a sub-pixel determining means for determining a size of a sub-pixel with respect to the first direction based on the specified preciseness;

a converting means for converting an ejection data to a sub-pixel data based both on the specified resolution and the size of the sub-pixel; and a control means for controlling the head based on the sub-pixel data to selectively ejecting the droplets from the nozzles.

2. The ejection device according to claim 1, wherein the sub-pixel determining means determines a largest one of sizes available for realizing the specified preciseness as the size of the sub-pixel.

3. The ejection device according to claim 1, further comprising at least one driver connected to at least two of the nozzles, wherein the sub-pixel determining means determines a size, as the size of the sub-pixel, with which the head ejects a droplet from only one of the at least two of the nozzles at one time.

4. The ejection device according to claim 3, wherein the control means includes a driving-signal means for applying a driving signal to each nozzle and a waveform determining means for determining a waveform of the driving signal, the waveform determining means determining the waveform for each nozzle individually.

5. The ejection device according to claim 1, wherein the head is an inkjet head.

6. The ejection device according to claim 1, wherein the head selectively ejects droplets from the nozzles so as to selectively form a single dot in each pixel defined on the medium, wherein the pixel is divided into the plurality of sub-pixels in the first direction.

7. The ejection device according to claim 1, further comprising an adjusting means for adjusting the orientation of the head to realize the specified angle.

8. The ejection device according to claim 1, further comprising an ejection-data generation means for generating the ejection data based on a bitmap data received from an external device, the ejection data being pixel data.

9. An ejecting device comprising:

a head formed with a plurality of nozzles arranged in a row, the row of the nozzles being angled with respect to a first direction;

a transporting means for transporting a medium with respect to the head in a second direction perpendicular to the first direction;

a timing-signal generating means for generating a timing signal in accordance with a position of the medium;

a driving-signal generating means for generating a driving signal in synchronization with the timing signal;

a converting means for converting an ejection-tone data into a pulse-width signal in synchronization with the timing signal;

a chance-signal providing means for providing a chance signal, the chance signal providing a chance for ejection to a selected one of the nozzles at a time in synchronization with the timing signal; and a control means for controlling the head to selectively eject a droplet from the selected nozzle based on the driving signal, on the pulse-width signal, and on the chance signal.

10. The ejection device according to claim 9, wherein the driving signal is a common analog driving signal used for all the nozzles, and the ejection-tone data is individual data prepared for each one of the nozzles.

11. The ejecting device according to claim 9, wherein the chance-signal providing means provides the chance signal by rotating a default data one bit at a time in synchronization with the timing signal.

12. The ejecting device according to claim 9, further comprising a memory for storing chance data, wherein the chance-signal providing means provides the chance signal by retrieving the chance data from the memory in synchronization with the timing signal.

13. The ejecting device according to claim 9, wherein the timing-signal generating means generates the timing signal more than one time each time the transporting means transports the medium by one-pixel worth of distance, and the head selectively ejects droplets from the nozzles to selectively form a single dot in each pixel defined on the medium.

14. The ejecting device according to claim 9, wherein the head is an inkjet recording head for ejecting ink droplets.

15. The ejection device according to claim 9, wherein the timing signal generation means generates the timing signal at least the same number of times as the plural number of the nozzles each time the transporting means transports the medium by a single pixel worth of distance, and the control means controls the head to selectively eject the droplets to form a single dot in each pixel on the medium.

16. The ejection device according to claim 9, further comprising an ejection-tone data generating means for generating the ejection-tone data based on a bitmap data received from an external device.

17. The ejection device according to claim 9, wherein the pulse-width signal has a width corresponding to the ejection-tone data.

* * * * *